US009387962B2

(12) United States Patent
Mercado et al.

(10) Patent No.: US 9,387,962 B2
(45) Date of Patent: Jul. 12, 2016

(54) RESEALABLE CONTAINER WITH COLLAR AND LID

(71) Applicant: Mead Johnson Nutrition Company, Glenview, IL (US)

(72) Inventors: Grace Mercado, Singapore (SG); Patrick McCallister, Newburgh, IN (US); Prasad Ventrapragada, Newburgh, IN (US); Simon Tan, Singapore (SG); Sundaramurthy Dandapani, Singapore (SG)

(73) Assignee: Mead Johnson Nutrition Company, Glenview, IL (US)

( * ) Notice: Subject to any disclaimer, the term of this patent is extended or adjusted under 35 U.S.C. 154(b) by 128 days.

(21) Appl. No.: 14/166,240

(22) Filed: Jan. 28, 2014

(65) Prior Publication Data

US 2015/0210444 A1 Jul. 30, 2015

(51) Int. Cl.

| | |
|---|---|
| ***B65D 43/22*** | (2006.01) |
| ***B65D 43/16*** | (2006.01) |
| ***B65D 21/02*** | (2006.01) |
| ***B65D 81/34*** | (2006.01) |
| ***A47G 19/06*** | (2006.01) |

(52) U.S. Cl.

CPC ..... *B65D 43/22* (2013.01); *A47G 19/06* (2013.01); *B65D 21/0204* (2013.01); *B65D 43/16* (2013.01); *B65D 43/163* (2013.01); *B65D 81/34* (2013.01)

(58) Field of Classification Search

CPC ..... B65D 51/24; B65D 51/18; B65D 43/16; B65D 81/34

USPC ..... 220/259.1, 735, 849, 254.3, 697

See application file for complete search history.

(56) References Cited

U.S. PATENT DOCUMENTS

| | | | | |
|---|---|---|---|---|
| 5,657,894 | A | 8/1997 | Bowen | |
| 5,810,188 | A * | 9/1998 | Novakoski | B65D 43/169 215/237 |
| 5,910,188 | A | 6/1999 | Resnick | |
| 6,761,279 | B1 | 7/2004 | Martin et al. | |
| 6,761,283 | B1 | 7/2004 | Gilliam et al. | |
| 6,772,904 | B1 | 8/2004 | Gilliam et al. | |
| D504,318 | S | 4/2005 | Lane et al. | |
| D553,988 | S | 10/2007 | Perry et al. | |
| D576,035 | S | 9/2008 | Perry et al. | |

(Continued)

FOREIGN PATENT DOCUMENTS

| | | |
|---|---|---|
| EP | 0773172 | 5/1997 |
| WO | 2010141841 | 12/2010 |

(Continued)

*Primary Examiner* — Anthony Stashick
*Assistant Examiner* — Robert Poon
(74) *Attorney, Agent, or Firm* — Patterson Intellectual Property Law, P.C; James R. Cartiglia; Timothy L. Capria

(57) ABSTRACT

The present disclosure relates to a container for holding a granular product or powdered material, such as infant formula. More specifically the disclosure is directed to a container including a closure having a collar and lid for resealably securing the open end of the container. The container may include a tub having a continuous groove located in the upper portion of the tub and a collar having a continuous tub mating surface extending about the entire perimeter of the collar for engaging the continuous groove of the tub, thereby securing the collar to the tub. The collar may also include a lid.

6 Claims, 17 Drawing Sheets

(56) References Cited

U.S. PATENT DOCUMENTS

| | | | | |
|---|---|---|---|---|
| 7,661,528 | B2 | 2/2010 | Vovan et al. | |
| 7,694,845 | B2 | 4/2010 | Tilton | |
| D624,406 | S | 9/2010 | Cronican et al. | |
| D646,966 | S | 10/2011 | Gill et al. | |
| D661,588 | S | 6/2012 | Irani et al. | |
| 2004/0238553 | A1 | 12/2004 | Lane et al. | |
| 2005/0242095 | A1* | 11/2005 | Serrano | B65D 55/16 220/254.3 |
| 2006/0000840 | A1* | 1/2006 | Kipperman | A61J 9/00 220/735 |
| 2008/0041861 | A1 | 2/2008 | Crawford et al. | |
| 2008/0156808 | A1* | 7/2008 | Perry | B65D 25/2897 220/560.03 |
| 2010/0108670 | A1 | 5/2010 | Perry et al. | |
| 2010/0236966 | A1 | 9/2010 | Luttik et al. | |
| 2010/0308044 | A1 | 12/2010 | Perry et al. | |
| 2010/0308065 | A1* | 12/2010 | Vandamme | B65D 43/169 220/697 |
| 2010/0308066 | A1 | 12/2010 | Perry et al. | |
| 2011/0186570 | A1 | 8/2011 | Perry et al. | |
| 2011/0192847 | A1 | 8/2011 | Vandamme | |
| 2012/0000925 | A1 | 1/2012 | Dols | |
| 2012/0061413 | A1 | 3/2012 | Dols | |
| 2013/0081364 | A1* | 4/2013 | Piscopo | B65B 69/00 53/492 |

FOREIGN PATENT DOCUMENTS

| | | |
|---|---|---|
| WO | 2011127133 | 10/2011 |
| WO | 2012047891 | 4/2012 |
| WO | 2012085783 | 6/2012 |
| WO | 2013163583 | 10/2013 |

* cited by examiner

RESEALABLE CONTAINER WITH COLLAR AND LID

TECHNICAL FIELD

The present disclosure relates to a container for holding a granular product or powdered material, such as infant formula. More specifically, the disclosure is directed to a container including a closure having a collar and lid for resealably securing the open end of the container.

BACKGROUND

There are many products in granular or powdered form that are currently packaged in containers. These products include, but are not limited to, infant formula, flour, coffee, sugar, and nutritional supplements, such as protein supplements. Since many of these products are stored, shipped, sold and dispensed from the same container, the container should be designed to withstand the rigors to which it will be exposed, but must be user friendly for the consumer.

Plastic containers are sometimes used to store and transport various granular materials, especially in the industrial and food sectors. Some of these containers may include a lid such that the container can be opened and closed. However, depending on the particle size of the granular product, the product may leak from the plastic container, especially in and around the area where the lid seals the container. Accordingly, while many plastic containers include resealable lids so that users may open the container multiple times to extract product from the interior of the container, often times, these resealable lids are not securely attached to the tub of the container such that the granular product does not leak from the container.

Moreover, many containers that include a resealable closure often do not provide complete closure of the container. For example, many lids and other closures for plastic containers still include very slight gaps between the lid and the tub portion of the container, which allow for fine particles or even small insects in the case of extreme climatic conditions, such as in tropical climates, to come into contact with the contents of the container.

Additionally, especially in the case of food products, the primary seal of the container should be tamper evident so that the contents of the container cannot be accessed before being purchased and consumed by the user. For example, other prior art closures may be opened prior to the first opening by the user. When this occurs, the contents of the container may be contaminated, which may cause the product to be unfit for consumption by the user.

Accordingly, there exists a need for a closure that more completely seals the container in order to prevent the contents of the container from leaking or to prevent insects and other contaminants from affecting the contents of the container. Additionally, there exists a need for a closure that remains tamper evident prior to first opening of the container.

As such, the present disclosure provides a tub having a closure comprising a lid and collar assembly, wherein the collar is securely attached to the tub such that the contents of the tub will not leak and further, such that the collar cannot be removed without indication to the user that it has been removed. Additionally the collar and lid form several sealing areas when the lid is securely closed and after the primary seal has been removed by the consumer thereby reducing the likelihood of external contaminants from accessing the tub. Moreover, the container of the present disclosure includes a closure comprising a collar and a lid that securely closes the container such that the product in the container does not leak between and/or during multiple uses and/or openings of the container.

BRIEF SUMMARY

In one aspect of the present disclosure, an improved container is provided. This and other aspects may be achieved by providing a container comprising a tub having an interior portion formed by a base and at least one wall. More particularly, the container may comprise a tub an interior portion formed by a base, a front wall, a rear wall, and opposing side walls. In some embodiments the container includes a closure adapted to be releasably sealed on the tub, wherein the closure includes a collar and a lid.

In some embodiments, the collar includes a tub mating surface designed to securely engage a collar mating surface located in a groove on the neck of the tub of the container. In some embodiments, the collar includes at least one thinned area and/or a plurality of thinned areas to facilitate assembly of the container. In still other embodiments, the collar is designed with a laterally extending flange having a U-shape, which provides flexibility to the collar so that it may be secured onto the perimeter of the tub.

The tub may, in some embodiments, include an anti-rotation element, which prevents the collar from slipping around about the perimeter of the tub and therefore adds stability to the seal between the collar and the tub. The collar may also include an anti-rotation engagement element that engages the anti-rotation element located on the tub, therefore preventing the collar from slipping around the perimeter of the tub, and providing further structural stability to the tub, collar and lid assembly. Additionally, since the anti-rotation element stabilizes the collar to which the lid is attached, the lid remains in proper placement on the tub so that the container can be opened and resealably closed multiple times by the user.

In embodiments, the tub includes a circumferential channel defined by the walls and base with the channel being adapted to receive a scoop to facilitate removal of the contents of the container. In some embodiments, the container comprises a scoop having a handle coupled to a cylindrical bowl. The radius of the cylindrical bowl may be substantially equal to the radius of the container channel so that the bowl can be received by the channel and allow for scooping of the container contents.

DETAILED DESCRIPTION

Figure 1:
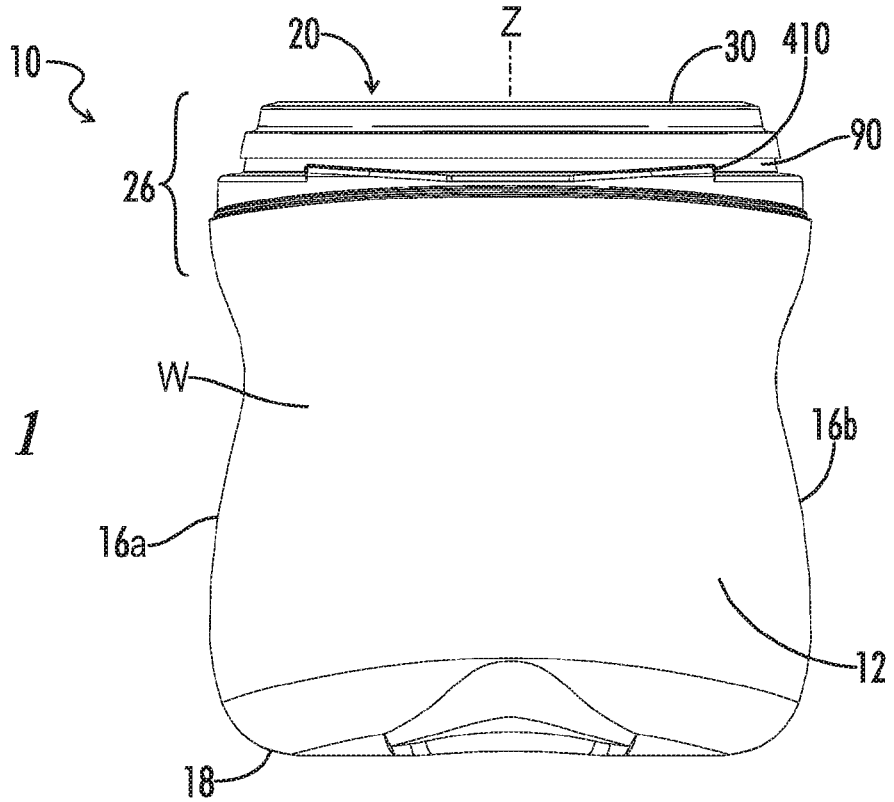
FIG. 1 shows a front view of the tub.

Reference now will be made in detail to the embodiments of the present disclosure, one or more examples of which are set forth hereinbelow. Each example is provided by way of explanation of the container of the present disclosure and is not a limitation. In fact, it will be apparent to those skilled in the art that various modifications and variations can be made to the teachings of the present disclosure without departing from the scope of the disclosure. For instance, features illustrated or described as part of one embodiment, can be used with another embodiment to yield a still further embodiment.

Thus, it is intended that the present disclosure covers such modifications and variations as come within the scope of the appended claims and their equivalents. Other objects, features and aspects of the present disclosure are disclosed in or are apparent from the following detailed description. It is to be understood by one of ordinary skill in the art that the present discussion is a description of exemplary embodiments only and is not intended as limiting the broader aspects of the present disclosure.

For the sake of clarity, not all reference numerals are necessarily present in each drawing figure. In addition, positional terms such as "upper," "lower," "side," "top," "bottom," "vertical," "horizontal," etc. refer to the container when in the orientation shown in the drawing. The skilled artisan will recognize that containers can assume different orientations when in use.

In some embodiments, the tub 10 is open on one side opposite its bottom or base 18 and may be of any suitable shape know in the art, including but not limited to, cylindrical, tapering, parallelepiped shaped, and waisted. An annular side wall W of the tub 10 extends about a vertical central axis Z defining an opening flange 30. The opening flange 30 defines the opening of the tub 10. The opening flange 30 may be on a shallow slope descending away from the opening 20 as can be seen in the non-restrictive example show in FIG. 1 and FIG. 5, or may be in a horizontal plane coinciding with the plane of the opening 20.

Figure 2:
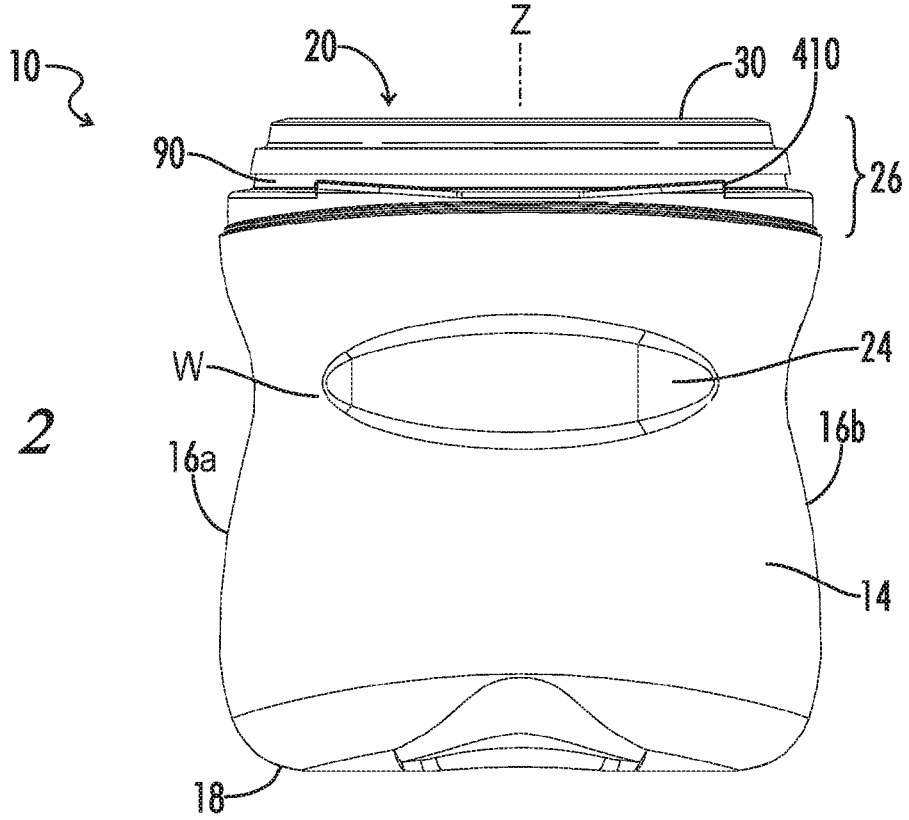
FIG. 2 shows a rear view of the tub.
Figure 3:
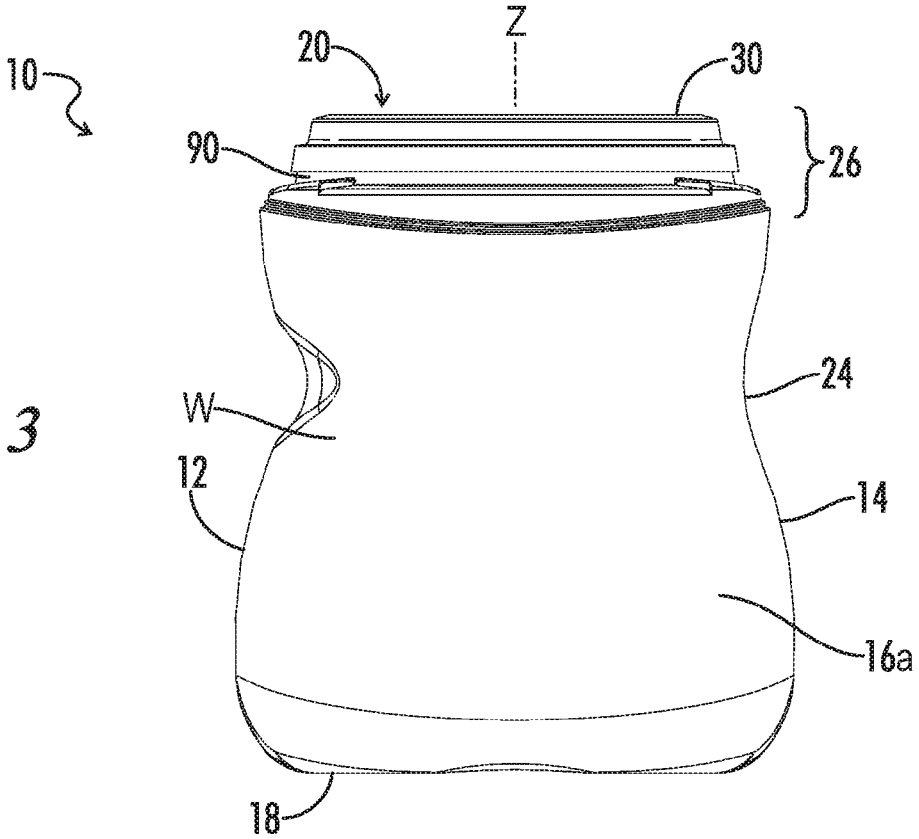
FIG. 3 shows a side view of the tub.

In some embodiments, the cross section perpendicular to the central axis Z of the tub 10 may be substantially rectangular, but with rounded corners. For example, as shown in FIGS. 1, 2 and 3, this section varies somewhat along the central axis Z to form a waist for easier gripping of container, but these variations may be limited to ensure the vertical strength of the containers is retained when stacked.

Without implying any restriction, the tub 10 may be made as a single thermally blow-molded plastic component. In some embodiments, the plastic component comprises a highly effective oxygen barrier that is suitable for use with a granulated product, such as powdered milk. In some embodiments, however, the tub could comprise some other material such as metal, paperboard, or a multilayer cartonboard.

In some embodiments the container may include a base 18 and at least one side wall. In an embodiment, referring to FIGS. 1-2, the tub 10 includes a front wall 12, rear wall 14, first side wall 16*a* and second side wall 16*b*. The lower portion of the front wall 12, rear wall 14, first and second side walls 16*a* and 16*b* are coupled to a base 18. Generally, the base 18 forms the bottom of the tub 10. The inner surfaces of the front wall 12, rear wall 14, first side wall 16*a*, second side wall 16*b* and base 18 form the interior space 22 of the tub where granular product may be stored. Further, the granular product may be placed in the tub 10 and removed from the tub 10 through the opening 20.

In some embodiments, the upper portion of the tub 10 refers to the top half or the top 50% of the front wall 12, rear wall 14, first side wall 16*a*, and second side wall 16*b*. In some embodiments, the upper portion of the tub 10 refers to the top quarter or the top 25% of the front wall 12, rear wall 14, first side wall 16*a*, and second side wall 16*b*. In still some embodiments, the upper portion of the tub refers to the top 10% of the front wall 12, rear wall 14, first side wall 16*a*, and second side wall 16*b*. Still, in some embodiments where the tub 10 comprises a side wall W, the upper portion may refer to the top 50% of the side wall W. In some embodiments, the upper portion may refer to the top 25% of the side wall W or the top 10% of the side wall W.

In some embodiments, the upper portion of the front wall 12, rear wall 14, first side wall 16*a* and second side wall 16*b* of the tub 10 may comprise a neck 26. The neck 26 of the tub 10 may comprise the area of the front wall 12, rear wall 14, first side wall 16*a*, and second side wall 16*b* where the closure including the lid 50 and collar 40, may be secured to the tub 10. In embodiments, where the tub 10 includes a side wall W, the upper portion of the side wall W may comprise the neck 26 of the tub 10.

In some embodiments, the rear wall 14 comprises a grip recess 24 approximately midway up the rear wall 14 of the container. This grip recess 24 may be configured to facilitate the user's hand for gripping and picking up the container. The grip recess 24 may, in some embodiments, be oval and/or oblong in shape. The grip recess 24 may also comprise a variety of shapes including, but not limited to, circular, ellipsoidal, elliptical and/or rectangular. In still some embodiments, the grip recess 24 may be positioned such that the user may grip and open the lid of the container with one hand. FIG. 2 displays a rear view of the container illustrating the rear wall 14 having a grip recess 24 thereon. Additionally, FIG. 3 shows a side view of the container further illustrating the grip recess 24 located in the rear wall 14.

Figure 4:
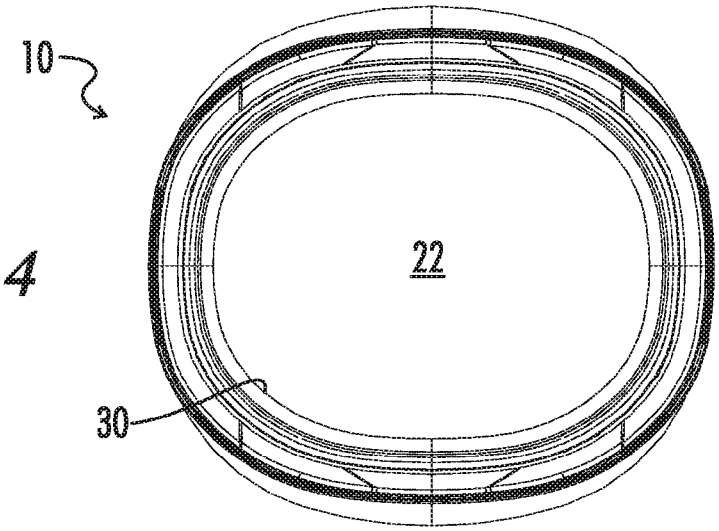
FIG. 4 shows a top view of the tub including the opening of the tub.

Referring now to FIG. 4, a top view of the tub 10 is shown. The front wall 12, rear wall 14, first side wall 16*a* and second side wall 16*b* form the interior space 22 of the tub. Further the tub 10 includes opening flange 30 which defines the perimeter of the opening 20 of the container. In some embodiments, the opening flange 30 is substantially parallel to the base 18 of the container. See FIG. 5. Still in some embodiments, the opening flange 30 may be substantially perpendicular to the neck 26 portion of the tub 10.

In some embodiments, the opening 22 of the tub 10 comprises an access ratio. In certain embodiments, the access ratio is functionally sized such that the users hand fits comfortably within the tub while still allowing the opening to be small enough to keep the overall container as a reasonable size. For example, in embodiments where an infant formula is stored in the container, the container should be sized such that it fits within a child's diaper bag without taking up too much room in the bag. Additionally, the access ratio of the opening of the tub is such that the user's hand fits comfortably within the opening, allowing the user to remove contents from the tub without the user's hand touching the opening 22 or the inner walls of the tub, thereby contaminating the contents of the container.

Figure 5:
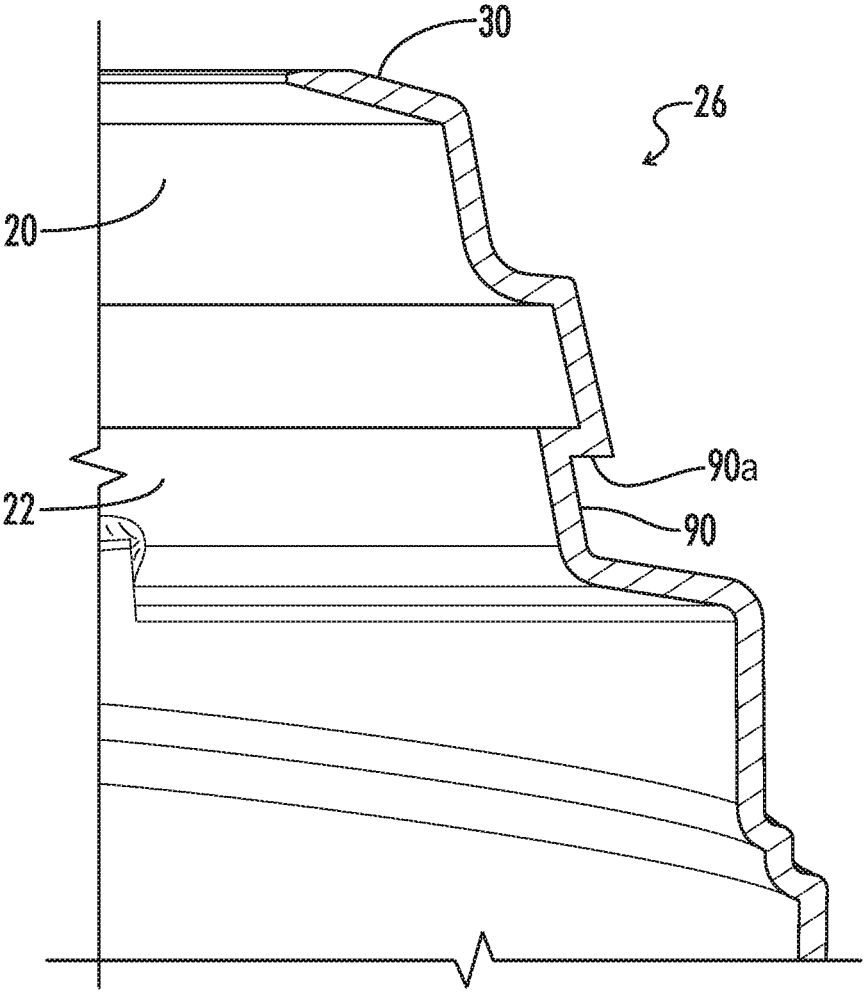
FIG. 5 shows a cut-out view of the wall of the tub including the opening flange and the groove.

Referring now to FIGS. 1 and 5, the tub 10 may comprise a groove 90 generally situated around the neck 26 of the tub 10. The groove 90 is designed to engage the collar 40, thereby securing the collar 40 to the tub 10. In some embodiments the groove 90 comprises an annular groove extending around the entire perimeter of the neck 26 of the tub 10. The groove 90 projects inwardly into the interior space 22 of the tub 10 and opens exteriorly. See FIG. 5. In some embodiments, the tub 10 comprises a collar mating surface 90*a*. The collar mating surface 90*a* may be located in the groove 90 of the tub 10. In some embodiments, the collar mating surface 90*a* may be located on the upper surface of the groove 90 of the tub 10. Generally, the collar mating surface 90*a* is designed to engage the tub mating surface 86 of the collar 40, thereby securing the collar 40 to the tub 10.

In some embodiments, the tub includes a raise protrusion 410. In some embodiments, as shown in FIGS. 1-2, the raised protrusion is located generally about the neck 26 of the tub 10. In some embodiments, the tub 10 includes at least one raised protrusion 410. In still other embodiments, the tub 10 includes a plurality of raised protrusions 410. For example, as can be seen in FIG. 1, one raised portion 410 may be generally located about upper portion of the front wall 12 of the tub 10 and, as can be seen in FIG. 2, another raised portion 410 may be generally located about the upper portion of the rear wall 14 of the tub 10.

Figure 6:
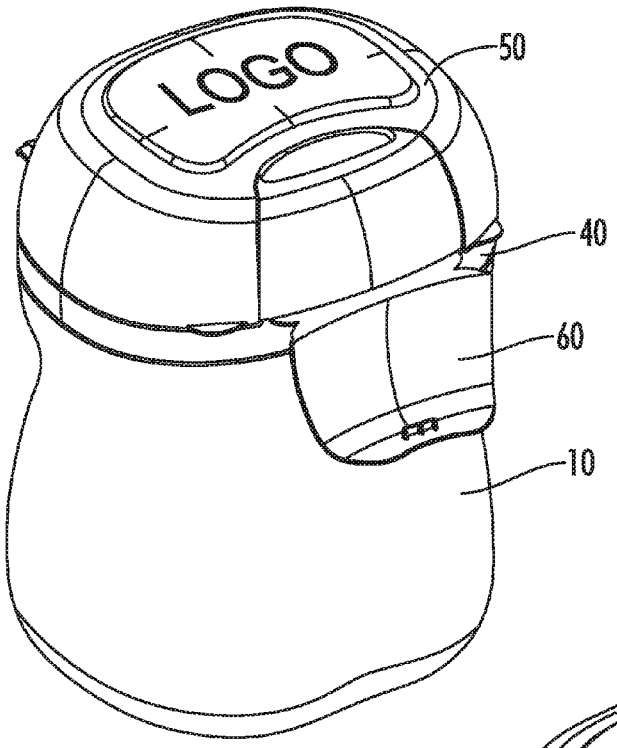
FIG. 6 shows the tub with closure attached where the lid is in closed position on the collar and the latch is not securely closed to the lid.
Figure 7:
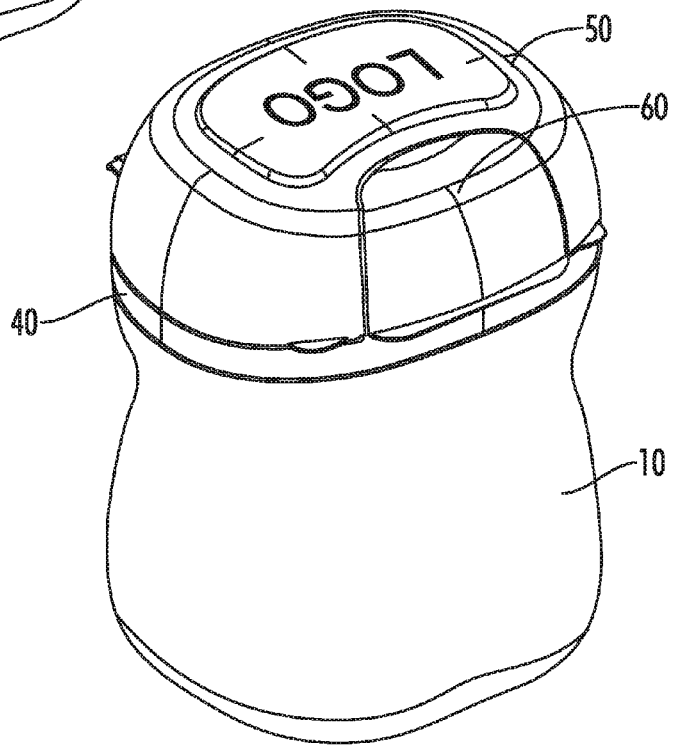
FIG. 7 illustrates the container having a tub with a collar and lid attached thereto wherein the latch is sealingly engaged in closed position with the lid.
Figure 8:
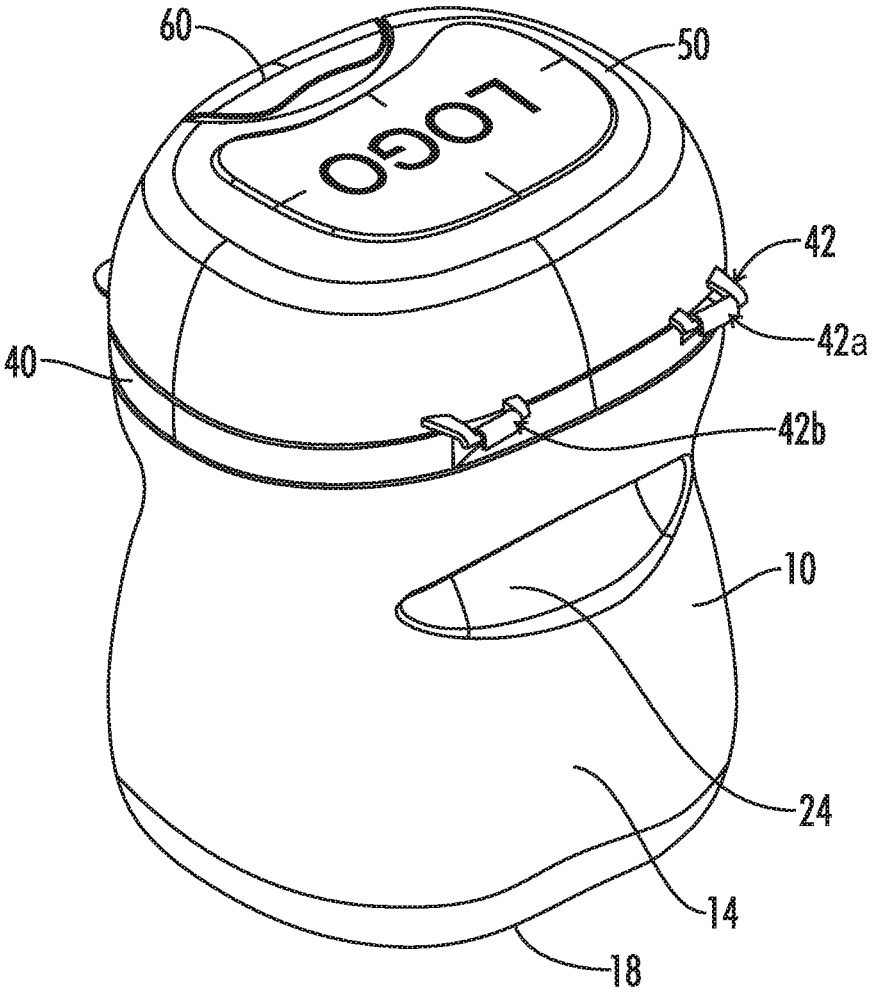
FIG. 8 shows a rear view of the container where the latch is hingedly attached to the lid.

Referring now to FIG. 6, the tub 10 may include a closure comprising a collar 40 and lid 50. In embodiments, the collar 40 comprises a latch 60; the latch 60 may be utilized to securely close the lid 50 to the tub 10. The latch 60 may be in an open or closed position. For example, in FIG. 6 the latch 60 is shown in an open position, while in FIG. 7 the latch 60 in shown in a closed position. In FIG. 7 a portion of the latch 60 is releasably secured to the top surface of the lid 50 thereby securing the lid 50 in a closed position on the tub 10. Additionally, FIG. 8 shows the latch 60 in closed position securely closing the lid 50 to the tub 10. FIG. 8 further shows the rear wall 14 and the grip recess 24. The lid 50 may be hingedly attached to the collar 40 by at least one hinge 42. In some embodiments the lid 50 may be hingedly attached to the collar 40 by at least two hinges, shown as 42*a* and 42*b* respectively. In still some embodiments, the lid 50 may be hingedly attached to the collar 40 by a plurality of hinges.

Figure 9A:
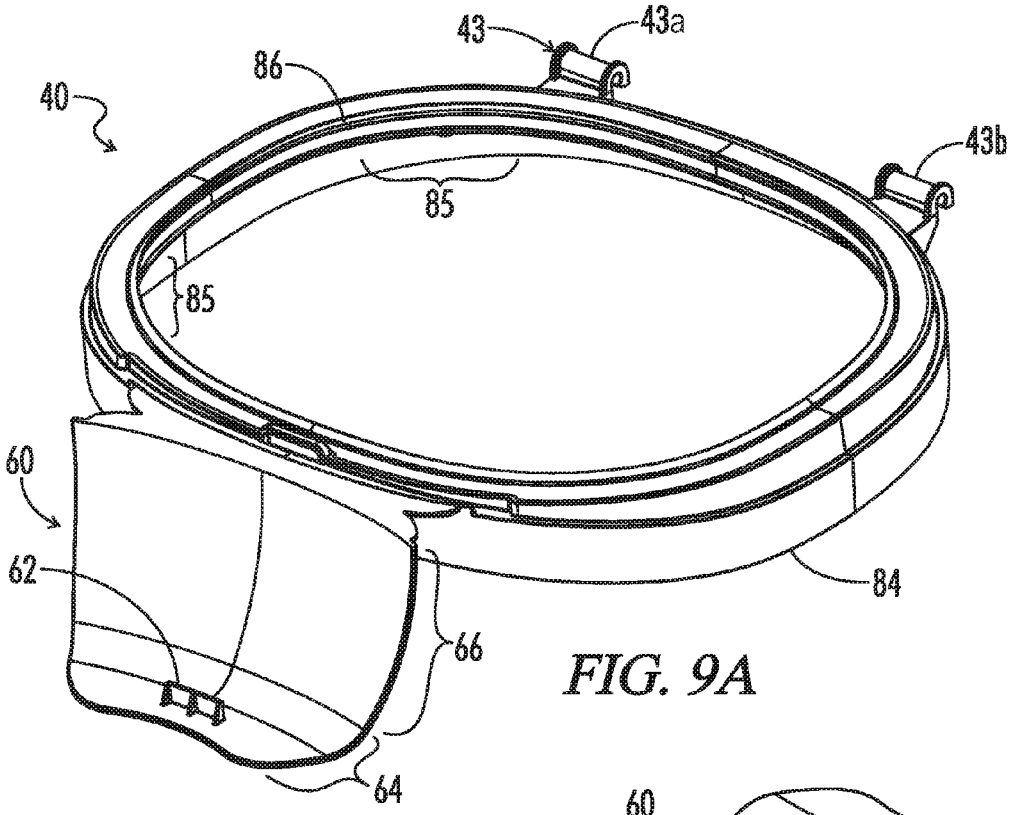
FIG. 9A shows top view of the collar including the latch.

Referring now to the collar 40, FIG. 9A shows a top view of the collar 40. In some embodiments the latch 60 is integrally molded to the collar 40. In still other embodiments, the latch 60 may be attached to the collar 40 by any suitable method known in the art after the collar 40 is molded. The latch 60 includes a lid engaging flange 62 that engages an aperture, opening, or other suitable structure in the lid 50 for securing the latch 60 to the lid. The lid engaging flange 62 may be any shape including, but not limited to, circular, ellipsoidal, rectangular or triangular. In some embodiments, the latch 60 may include a plurality of lid engaging flanges 62 to further secure the latch 60 to the lid 50 thereby further securing the lid 40 to the tub 10.

Still referring to FIG. 9A, the collar 50 may comprise at least one hinge attachment 43 for hingedly securing the lid 50 to the collar 40. In some embodiments, the collar 40 may include at least two collar hinge attachments, denoted 43*a* and 43*b* respectively. In still some embodiments, the collar may comprise a plurality of hinge attachments.

Additionally, the latch 60 includes a lid surface flange 64 that is complementary in shape to the outer top surface 52 of the lid 50. The lid surface flange 64 is designed to rest on the outer top surface 52 of the lid 50. The latch 60 may further comprise a lid sealing wall engagement surface 66, designed to engage and/or rest against the outer surface of the outer sealing wall 72 of the lid 50. In some embodiments, the features of the latch 60 including the lid engaging flange 62, lid surface flange 64, and the lid sealing wall engagement surface 66, are designed to be complimentary to the overall size and shape of the lid 50.

Moreover, in some embodiments the lid engaging flange 62 may be substantially perpendicular to the plane of the lid surface flange 64 of the latch 60. Additionally, the lid engaging flange 62 may be substantially parallel with the walls of the tub 10 when the latch 60 is in closed position. As further displayed in FIG. 9A, the lid engaging flange 62 extends from the lid surface flange 64 of the latch 60 and is designed to engaged the lid 50 when the latch 60 is in closed position.

Figure 9B:
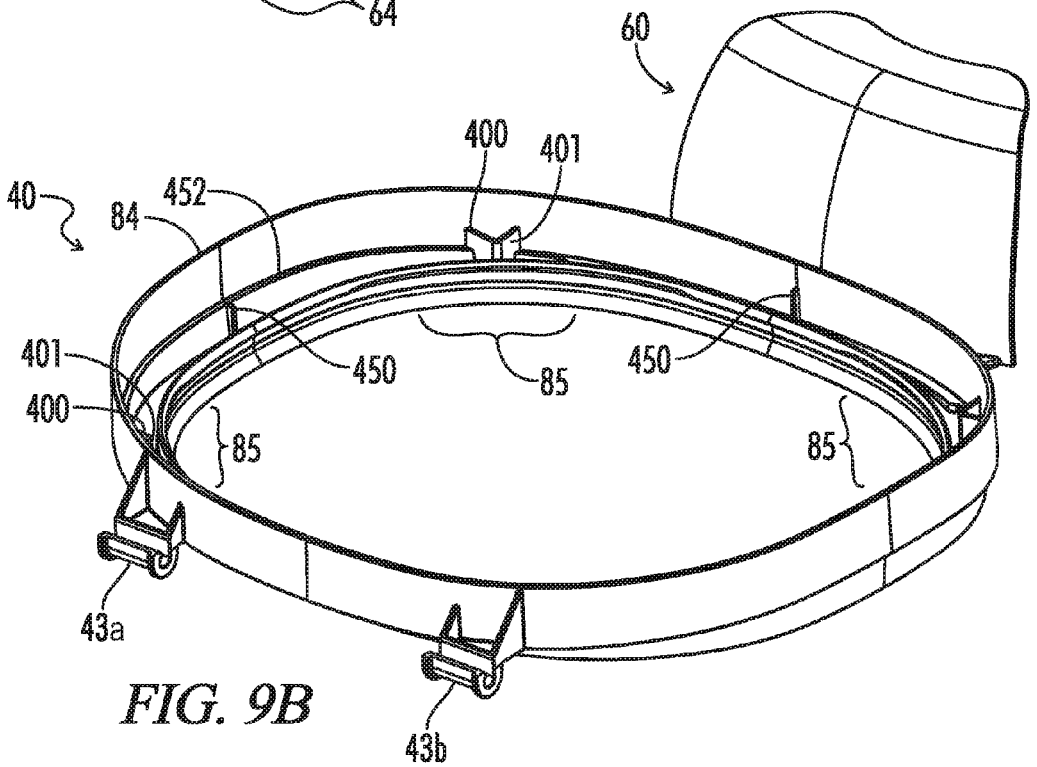
FIG. 9B illustrates the interior features of the collar.

In some embodiments the collar 40 may comprise an outer sealing wall 84 and a tub mating surface 86 as shown in FIG. 9B. The tub mating surface 86 may comprise a single attachment surface extending around the entire perimeter of the collar 40. In some embodiments, the tub mating surface 86 comprises an annular bead extending around the entire inner perimeter of the collar 40. In still other embodiments, the tub mating surface 86 comprises a flange extending around the entire perimeter of the collar 40.

The collar 40 is similar in shape to the outer surface of the neck 26 of the tub 10. For example, in embodiments where the side wall W of the tub 10 is circular, the collar 40 include a complementary circular geometry. Similarly, in embodiments where the side wall W of the tub 10 is rectangular, the collar 40 will be shaped in complementary rectangular fashion. More specifically, in some embodiments, the tub comprises four corner shaped areas. These areas, generally correspond to a corner area of the tub, however the corner areas may comprise a variety of shapes. As such, the term corner area is not meant to be limiting and merely describes an area of curvature about the opening 20 of the tub 10. The collar 40, including the tub mating surface 86, may be complementary to the overall corner areas of the tub 10.

In some embodiments, the corner area(s) may be formed where the various walls of the tub 10 meet. For example corners areas may be rounded corners, as shown in FIG. 4, or take on any suitable shape known in the art, including but not limited to, rectangular, ellipsoidal, or curved geometries having a variety of degree of curvatures. In some embodiments, the collar 40 may comprise complementary corner areas that correspond to the geometries of the corner areas of the tub. Further, in some embodiments, the collar comprises at least one recessed area 85. The at least one recessed area may be generally located in the corner are of the collar 40. In some embodiments, the collar 40 comprises a plurality of recessed areas 85. In some embodiments the at least one recessed area is located about the tub mating surface 86

Figure 11A:
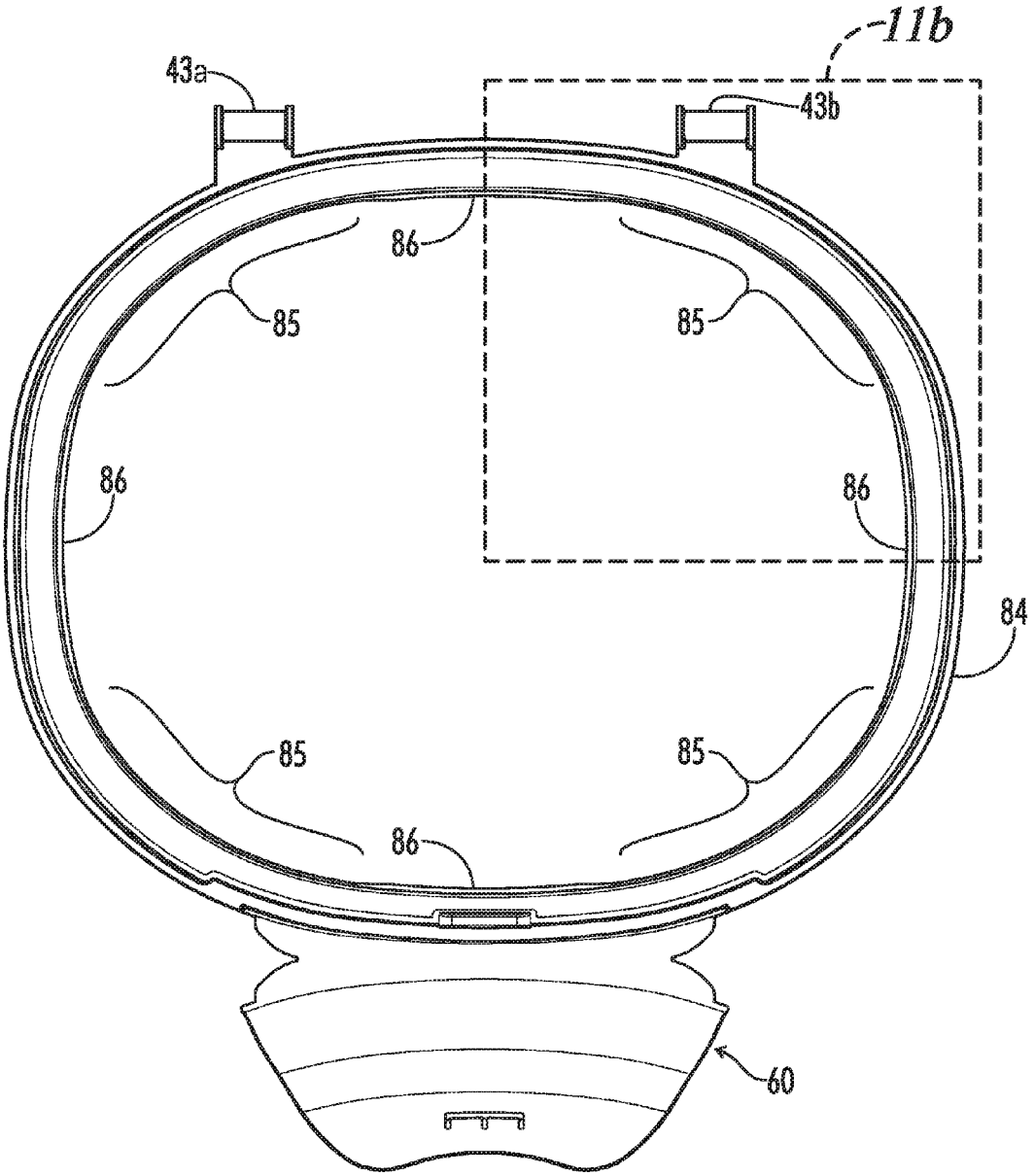
FIG. 11A provides a view of the collar displaying the features of the collar.
Figure 11B:
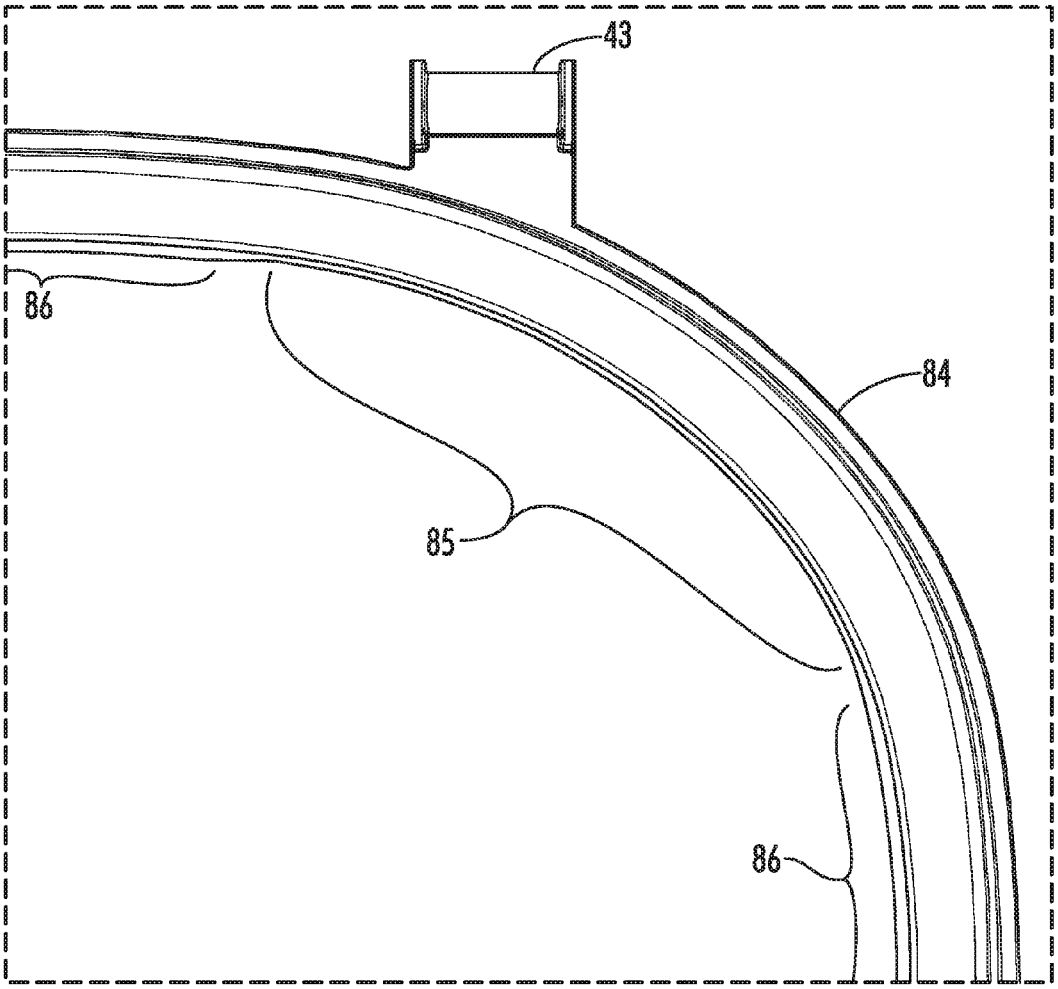
FIG. 11B shows and enlarged view of the thinned area located on the collar.

Generally, the at least one recessed area 85 provides flexibility to the tub mating surface 86 thereby ensuring that the tub mating surface 86 does not crack and/or break away from the collar 40 when the collar 40 is snap fitted to the neck 26 of the tub 10. Still in some embodiments, where additional flexibility is necessary, the collar 40 may comprise a plurality of recessed areas shown generally in FIGS. 9B, 11A and 11B. Generally the at least one recessed areas 85 of the tub mating surface 86 is thinned to permit increased resilience so that the collar 40 can be fitted over the tub 10 and snapped into place on the tub 10.

In some embodiments, the recessed area(s) 85 may be placed at any location of the tub mating surface 86. Further, the collar 40 may comprise a plurality of recessed areas 85, however, given the seal created between the tub 10 and the collar 40 when the tub mating surface 86 engages the collar mating surface 90*a* of the tub 10, the collar 40 should not include too many recessed areas 85 such that an effective seal between the collar 40 and the tub 10 is not achieved. Accordingly, in some embodiments, the number and placement of recessed areas 85 is optimized to promote both the flexibility and sealability of the collar 40, so that the collar 40 maintains an effective connection or seal with the tub and is not damaged when connected to the tub 10.

The collar 40 may include, in some embodiments, at least one stop member 400. In some embodiments the collar 40 may include a plurality of stop members 400. In still some embodiments, the stop member 400 may include a tub engagement surface 401. More specifically, as shown in FIG. 9B, in some embodiments the stop members 400 may be located generally in the corner areas of the collar 40. The stop members 400 may be located at a variety of locations about the innerside of the outer sealing wall 84 of the collar. As shown, in FIG. 9B, generally these stop members 400 engage a raised protrusion 410 located about the neck 26 of the tub 10, See. FIGS. 1-2. For example, one end of the raised protrusion 410 of the tub 10 may engage at least one surface of the stop member 400 and extend laterally about the neck 26 of the tub 10, wherein a second end of the raised protrusion 410 then engages at least one surface of another stop member 400. Additionally, in some embodiments one end of the raised protrusion 410 of the tub 10 engages at least one tub engagement surface 401 of the stop member 400, and the other end of the raised protrusion 410 engages at least one tub engagement surface 401 of another stop member 400.

More specifically, in some embodiments, the raised protrusion 410 may be snap-fitted or friction-fitted between two stop members 400 when the collar is connected to the neck 26 of the tub 10. In some embodiments, the raised protrusion 410 may be snap fitted between two tub engagement surfaces 401 of two stop members 400. Further, the tub 10 could include a plurality of raised protrusions 410 that engage a plurality stop members 400 located about the innerside of the collar 40. In some embodiments, the collar 40 may include at least four stop members 400, located about the innerside of the collar 40 to engage the ends of the two raised portions 410, thereby preventing the collar from rotating about the neck 26 of the tub 10.

In some embodiments the inner side of the outer sealing wall 84 of the collar 40 may include at least one rib 450. In some embodiments, the inner side of the outer sealing wall 84 may include a plurality of ribs 450. For example, as can be seen FIG. 9B, a rib 450 may be located about the inner side of the outer sealing wall 84 generally in the area where the latch 60 is attached to the collar 40. Placing a rib in this location of the collar 40, strengthens the collar 40 and prevents degradation, including crumpling or breaking of the collar 40, as the latch 60 is manipulated into an open and closed position multiple times by the user. As such, in some embodiments, the collar 40 may include a plurality of ribs 450, strategically placed and/or spaced about the collar 40, including the inner side of the collar 40 to prevent degradation or damage of the collar 40.

In some embodiments, the collar 40 may comprise a second wall 452 located generally between the outer sealing wall 84 and the opening of the collar 40. As can be seen in FIG. 9B, in some embodiments, one side of the second wall 452 engages the inner side of the outer sealing wall 84, thereby providing additional strength to the outer sealing wall 84. Still, in some embodiments, the second wall 452 of the collar may include a rib 450 located on the wall surface that is not in contact with the outer sealing wall 84. In some embodiments, the second wall 452 may comprise a plurality of ribs 450 located thereon. These ribs 450 may provide additional strength to the structure of the second wall 452, thereby strengthening the outer sealing wall 84 of the container and thus, strengthening the overall structure of the collar 40.

In some embodiments, one side of the second wall 452 of the collar engages the outer sealing wall 84 of the collar 40, and at least a portion of the other side of the second wall 452 may engage the outer surface of the tub 10. This engagement between the second sealing wall 452 of the collar 40 and tub 10 may create an additional seal between the tub 10 and the collar 40, thereby strengthening the connection between the tub 10 and the collar 40. This additional seal, may further prevent contaminants from entering the tub 10, and may also strengthen the neck 26 of the tub 10. Additionally, in embodiments where the second wall 452 of the collar 40 includes a rib 450 located thereon, the rib 450 may engage the tub 10 when the collar 40 is secured to the tub 10.

Figure 10A:
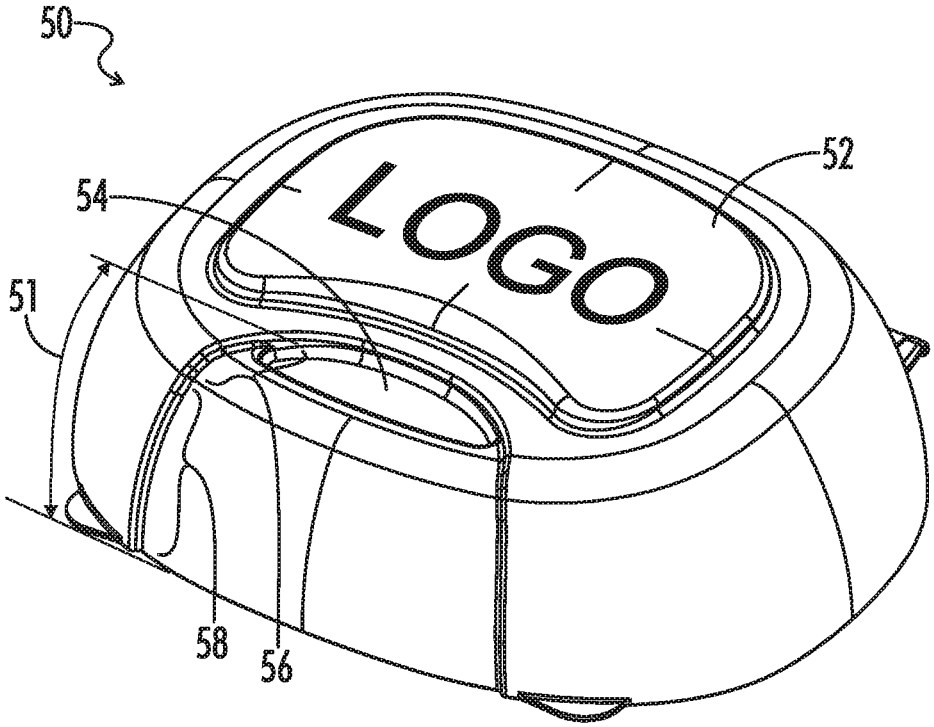
FIG. 10A shows the outer surfaces and features of the lid.
Figure 10B:
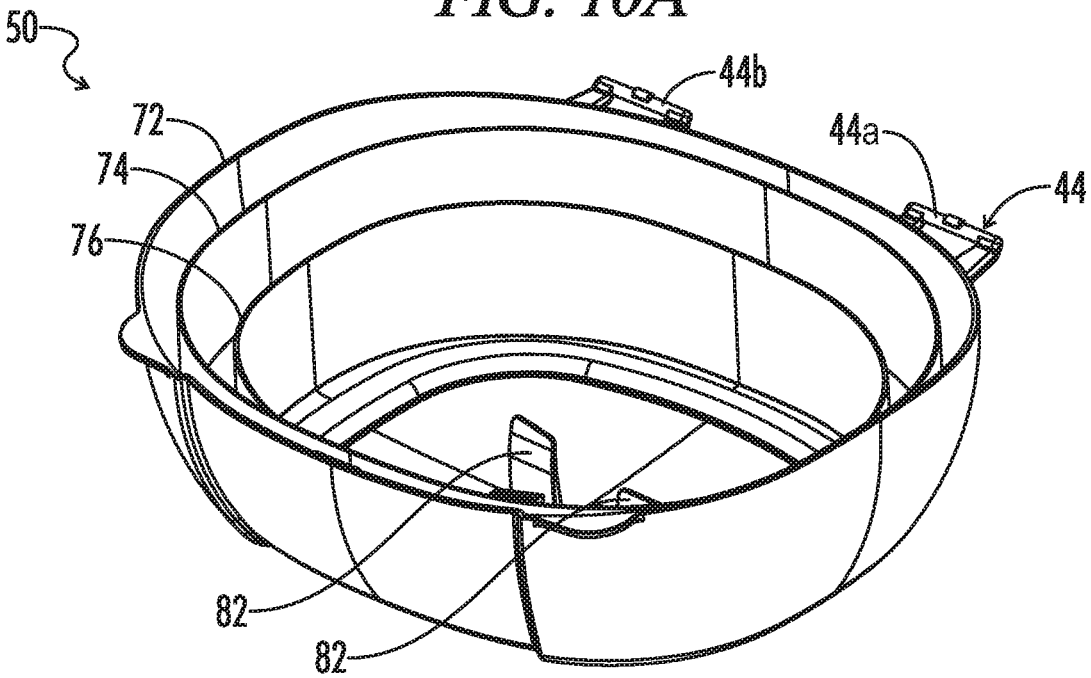
FIG. 10B shows the inner surface and features of the lid.

Referring now to FIGS. 10A-10B, the lid 50 may include an outer top surface 52. Additionally, the lid 50 may comprise at least one lid sealing wall 72. The lid 50 may further comprise a second lid sealing wall 74. In some embodiments, the lid may also comprise an inner sealing wall 76. The second lid sealing wall 74 may be located between the lid sealing wall 72 and the inner sealing wall 76. Moreover, the lid sealing wall 72 may, in some embodiments, comprise an outer surface substantially parallel with wall(s) of the tub. The upper portion of the lid sealing wall 76 contacts the outer perimeter of the outer top surface 52 of the lid 50.

Additionally, the lid 50 comprises a latch engagement portion 51. Generally the latch engagement portion 51 of the lid 50 is located on a portion of the outer surface of the lid sealing wall 72 and a portion of the outer top surface 52 of the lid 50. See. FIG. 10A. The latch engagement portion 51 may further comprise an engagement recess 54 for securely engaging the lid engaging flange 62 of the latch 60 thereby securing the collar 40 and latch 60 to the lid 50 and further securely closing the lid 50 to the tub 10.

Generally the recess of the latch engagement portion 51 is complementary in shape and depth to the latch 60, more specifically the recess may be complementary in shape to the lid surface flange 64 and the lid sealing wall engagement surface 66 of the latch 60. The recess may include a lid surface engagement recess 56 and an outer lid sealing wall recess 58. In this manner the lid surface flange 64 of the latch 60 is complementary in shape to the lid surface engagement recess 56 and the outer lid sealing wall engagement surface 66 of the latch 60 is complementary in shape to the lid sealing wall recess 58. This lid recess is designed to accommodate the dimensions of the latch 60, such that when the latch 60 is in closed position the latch 60 remains flush with both the outer top surface 52 and the outer surface of the lid sealing wall 72 of the lid 50. Moreover, when the latch 60 is moved into a closed position on the lid 50, the user will experience a tactile sensation when the latch 60 is securely engaged within the recess of the latch engagement portion 51 of the lid 50. This tactile sensation signals that the latch 60 is securely engaged with the lid 50 of the container.

In some embodiments, the lid engaging flange 62 of the latch 60, may make an audible sound, which can in certain embodiments be described as a "click", when it is inserted into the engagement recess 54 located within the latch engagement portion 51 of the lid 50. This clicking noise, which is audible to the user, indicates that the latch 60 has been secured to the lid 50, and further indicates that the lid 50 has been securely sealed to the tub 10.

The lid 50 may comprise at least one lid hinge attachment 44. In some embodiments the lid 50 may comprise a plurality of lid hinge attachments 44*a* and 44*b*. See FIG. 10B. The lid hinge attachments 44*a* and 44*b* are designed to be hingedly coupled with the collar hinge attachments 43*a* and 43*b* thereby hingedly attaching the collar 40 and the lid 50. When coupled, the lid hinge attachments 44*a* and 44*b* and the collar hinge attachments 43*a* and 43*b* comprise the hinges 42. In some embodiments, where hinged members are not desirable the collar 40 may be attached to the lid 50 by any suitable method known in the art. Nonlimiting examples for coupling the lid 50 to the collar 40 include utilizing heat, as in molding or welding the collar 40 and lid 50 together, or utilizing a suitable adhesive. Moreover, when the lid 50 and collar 40 are hingedly attached, they may be referred to generally as the closure.

Figure 12:
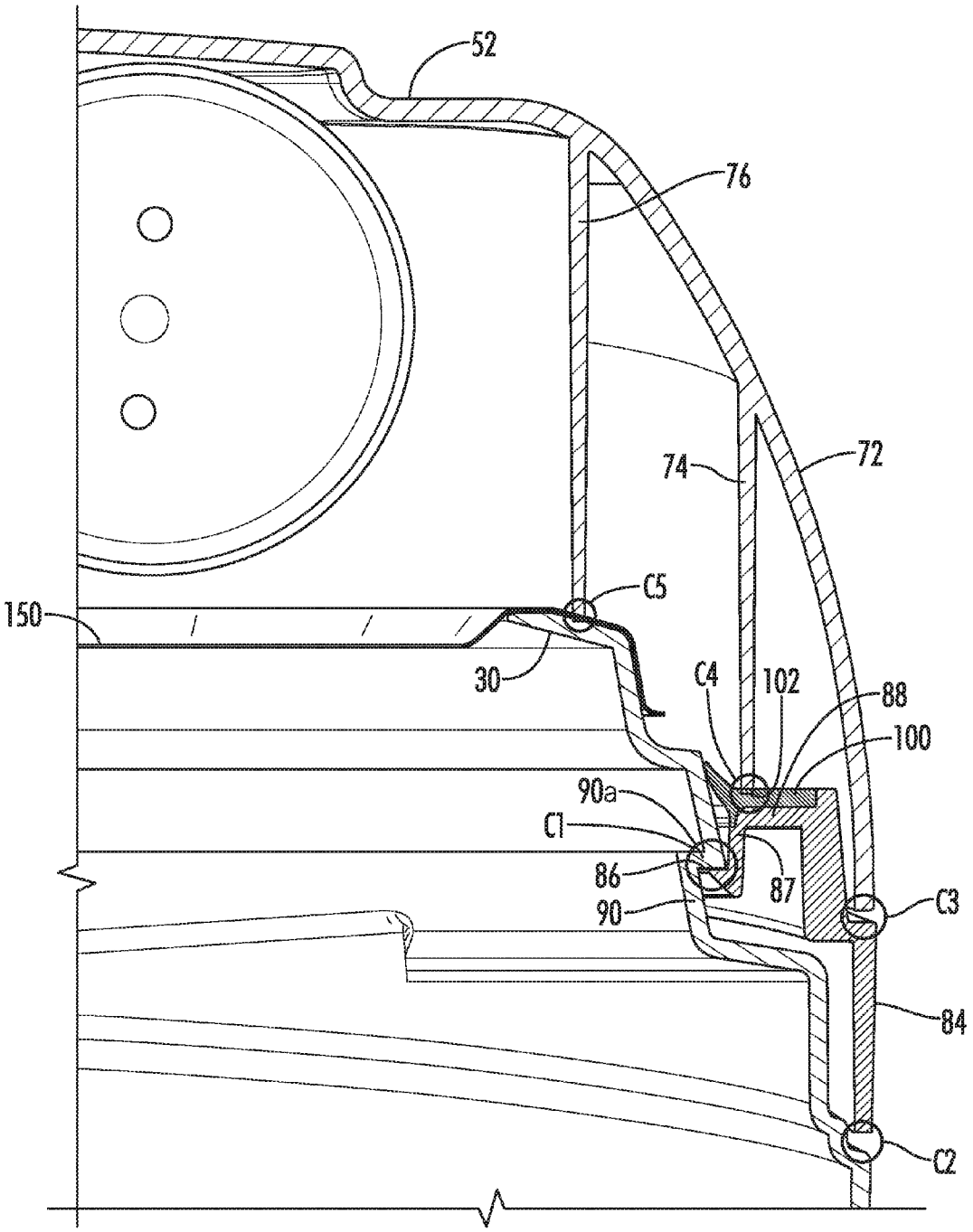
FIG. 12 shows a cross-section view of the tub, collar and lid, including features such as the sealable membrane and gasket.
Figure 13A:
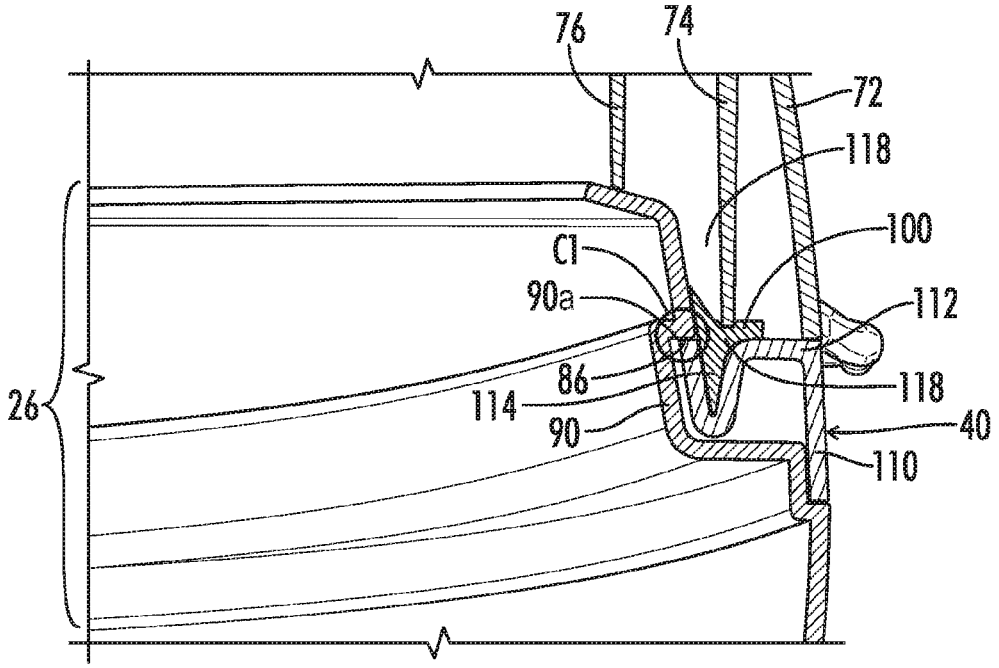
FIG. 13A shows a cross-section view of the tub, collar and lid, including a collar including a U-shaped laterally extending flange.
Figure 13B:
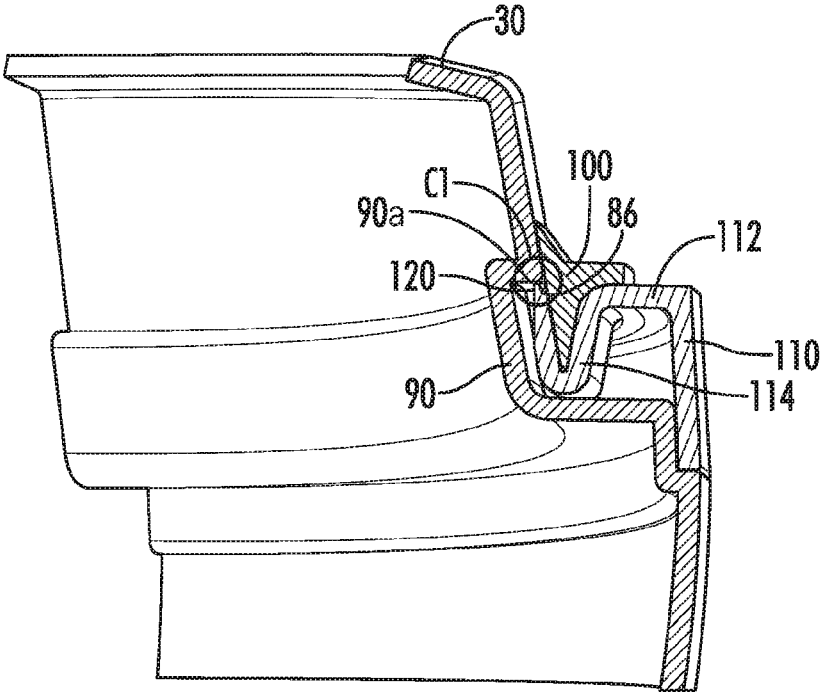
FIG. 13B shows a cross-section view of the tub, U-shaped collar and gasket.

Referring now to FIG. 12, in some embodiments the collar 40 comprises a collar flange 87 extending from the outer sealing wall 84 of the collar 40 toward the wall of the tub 10. In some embodiments, the collar flange includes a top surface 88. In some embodiments, the collar flange 87 may form a curved or rounded corner with the outer sealing wall 84 of the collar 40. Generally, when the collar 40 is fitted to the tub 10, one end of the collar flange 87 comprises the tub mating surface 86. Accordingly, the collar flange 87 may comprise a variety of shapes and may be bent, as shown in FIGS. 12, 13A, and 13B to allow the collar 40 to snap fit over the neck 26 of the tub 10.

When the collar 40 is snapped onto the tub 10, the collar flange 87 flexes laterally toward the outer sealing wall 84 of the collar 40 thereby allowing the tub mating surface 86 of the collar 40 to fit into the groove 90 of the tub 10. Once the collar 40, is snapped into place in the groove 90 of the tub 10, the collar flange end 87 flexes laterally back towards the tub 10 thereby facilitating a secure engagement between the tub mating surface 86 of the collar 40 and the collar mating surface 90*a* of the tub 10. In some embodiments, the tub mating surface 86 of the collar 40 continuously engages the collar mating surface 90*a* of the tub 10 about the entire perimeter of the tub 10.

In some embodiments, the seal created between the tub mating surface 86 of the collar 40 and the collar mating surface 90*a* of the tub 10 is labeled C1. The seal C1, in some embodiments, is a continuous seal extending around the entire perimeter of the tub 10 and the collar 40. Accordingly, since the seal of C1 is continuous around the perimeter of the tub 10, it provides additional stability to the overall structure of the container as compared to other prior art containers that do not have a continuous attachment seal between the collar 40 and the tub 10. Additionally, since C1 is continuous about the entire perimeter of the tub 10 it provides a tamper evident feature. For example, in the event that someone attempts to remove the collar 40 from the tub 10, the collar 40, especially the collar flange 87 and/or tub 10, may be damaged. This damage would indicate to the user that someone has tampered with the container.

Further, as shown by FIG. 12, one end of the outer sealing wall 84 of the collar 40 rests on the tub 10 thereby creating sealing region C2. Similar to C1, sealing region C2 is a continuous seal around the entire perimeter of the tub 10, located between the outer sealing wall 84 of the collar 40 and the tub 10. This continuous seal C2 provides a first defense from preventing foreign contaminants from accessing the interior contents of the container, thereby preserving the sanitary condition of the contents of the container.

A gasket 100 may be located on top surface 88 of the collar 40. In some embodiments, the gasket 100 may cover the top surface 88 of the collar 40. While in other embodiments, the gasket 100 may cover only a portion of the top surface 88 of the collar. In some embodiments, the gasket 100 is integrally molded to the top surface 88 of the collar 40. In still other embodiments, the gasket 100 is formed separately from the collar 40, and may be placed on the collar 40 prior to the collar 40 being snapped on to the tub 10. While still in other embodiments, the gasket 100 may be formed separately from the collar 40 and placed on the top surface 88 of the collar 40 after the collar 40 has been snapped into the groove 90 of the tub 10.

The gasket 100 may be comprised of any suitable material known in the art including, but not limited to any thermoplastic elastomer ("TPE"). Non-limiting examples of suitable TPEs that may be used herein include styrenic block copolymers, polyolefin blends, elastomeric alloys, thermoplastic polyurethanes, thermoplastic copolyester, thermoplastic polyamides, and any suitable combinations and mixtures thereof.

The lid 50, when in closed position, forms a seal C3 between the outer sealing wall 84 of the collar 40 and the lid sealing wall 72. This seal C3 is a continuous annular seal about the perimeter of the collar 40 and the lid 50 and therefore prevents contaminants from entering the container. Additionally, the second lid sealing wall 74 may form a continuous annular seal C4 with the top surface 88 of the collar 40. In some embodiments, the second lid sealing wall 74 forms a continuous annular seal C4 with the gasket 100 located on the top surface 88 of the collar. In embodiments where the second lid sealing wall 74 forms a continuous annular seal C4 with the gasket 100, the gasket 100 may be designed to include a sealing groove 102 which accommodates the end of the second lid sealing wall 74 distal from the inner top surface 78 of the lid 50. In this embodiment, the second lid sealing wall 74 provides a tactile signal to the user that the lid 50 is securely closed when the distal end of the lid sealing wall 74 is securely inserted into the sealing groove 102 of the gasket 100.

Additionally, the inner sealing wall 76 of the lid 50 may, in some embodiments, create a sealing region C5 with the opening flange 30 of the tub 10. The seal C5 may form a continuous annular seal between the inner sealing wall 76 of the lid 50 and the opening flange 30 of the tub 10. The sealing region C5 provides a first defense from preventing the contents of the tub 10 from spilling out of the tub 10 and onto the surrounding area and/or the gasket 100 and collar 40.

Accordingly, in some embodiments, the container of the present disclosure is designed with five continuous annular seals, C1, C2, C3, C4 and C5, respectively. Having a container including five continuous annular seals provides enhanced strength to the overall structure of the container, specifically strengthening the attachment between the collar 40, lid 50 and tub 10. Moreover, the five continuous annular seals enhance the overall sealability of the container, meaning that when in closed position, foreign contaminants are effectively kept from entering the interior space 22 of the tub 10 of the container. Accordingly, the granular product placed in the tub 10 is kept fresh and more sanitary, as compared to granular products placed in tubs that do not comprise the five continuous annular seals described herein.

Referring now to FIGS. 13A and 13B, in some embodiments the collar 40 may comprise an outer wall 110, and a laterally extending flange 112 that extends from the outer wall 100 of the collar towards the wall of the tub 10. The laterally extending flange 112 may include a U-shape or V-shape. In some embodiments, the U-shaped end of the laterally extending flange 112 comprises a tub mating surface 86 that engages the collar mating surface 90*a* of the tub 10. The collar mating surface 90*a* of the tub 10 may be located within groove 90 on the neck 26 of the tub 10.

The U-shaped end of the laterally extending flange 112 of the collar 40 may comprise a gasket 100. See FIGS. 13A and 13B. For example, when the collar 40 is secured to the tub 10 one surface of the laterally extending flange generally 112 faces the lid 50 and the other surface of the laterally extending flange 112 generally faces the tub 10. The opening of the U-shaped end of the laterally extending flange 112 may generally face the lid, therefore creating a groove 114 in the collar 40. In some embodiments the groove 114 of the collar 40 may comprise a gasket 100. The gasket 100 may fill at least a portion of the groove 114 or may fill the entire groove 114. See. FIGS. 13A and 13B.

In some embodiments, where the collar 40 comprises a groove 114, the second lid sealing wall 74 may make sealing contact within the groove 114 located on the laterally extending flange 112 of the collar 40. In some embodiments, the gasket 100 comprises a gasket groove 118 that extends, at least partially, into the groove 114 of the laterally extending flange 112 of the collar 40. In this embodiment, the second lid sealing wall 76 extends into the gasket groove 118 thereby engaging the gasket 100 and sealing the lid 50 to the collar 40. In some embodiments, when the second lid sealing wall 76 is secured within the gasket groove 118 located within the groove 114 of the laterally extending flange 112 of the collar 50, the user will experience a tactile sensation signaling that the lid 50 has been securely closed on the collar 40 and the tub 10. In some embodiments, when the second lid sealing wall 76 is secured within the gasket groove 118 the user may hear an audible noise signaling that the lid 50 has made a secure engagement with the gasket 100 located on the collar 40.

In some embodiments the laterally extending flange 112 of the collar 40 may be thinned at the end towards the tub mating surface 86. See FIG. 13B. While the tub mating surface 86 may extend around the entire perimeter of the tub and the laterally extending flange 112 of the collar 40, the laterally extending flange 112 may comprise at least one thinned area 120 that provides resilience such that the collar 40 may be snap-fitted on to the neck 26 of the tub 10. In some embodiments, the laterally extending flange 112 of the collar 40 may comprise at least two thinned areas 120. For example, the thinned area 120 of the laterally extending flange 112 of the collar 40 allows the collar 40 to flex laterally toward the outer sealing wall 84 of the collar 40, allowing the collar 40 to be fitted over the neck 26 of the tub 10. Once the collar 40 has been fitted over the neck 26 of the tub 10, the thinned area 120 of the laterally extending flange 112 then flexes back toward the wall of the tub 10, thereby allowing the tub mating surface 86 of the collar 40 to securely engage the collar mating surface 90*a* of the tub 10.

Moreover, the U-shaped groove of the laterally extending flange 112 provides flexibility to the collar 40 such that the collar 40 will not break when snap fitted on the neck 26 of the tub 10. The laterally extending flange 112 including a U-shaped groove provides not only additional flexibility when the collar 40 is snapped onto the tub 10, but also flexes toward the wall of the tub 10 therefore strengthening the seal C1 between the collar 40 and the tub 10. Additionally, the U-shaped groove on the laterally extending flange 112 flexes toward the walls of the tub 10 strengthening the seal between the tub mating surface 86 of the collar 40 and the collar mating surface 90*a* of the tub 10.

Figure 14:
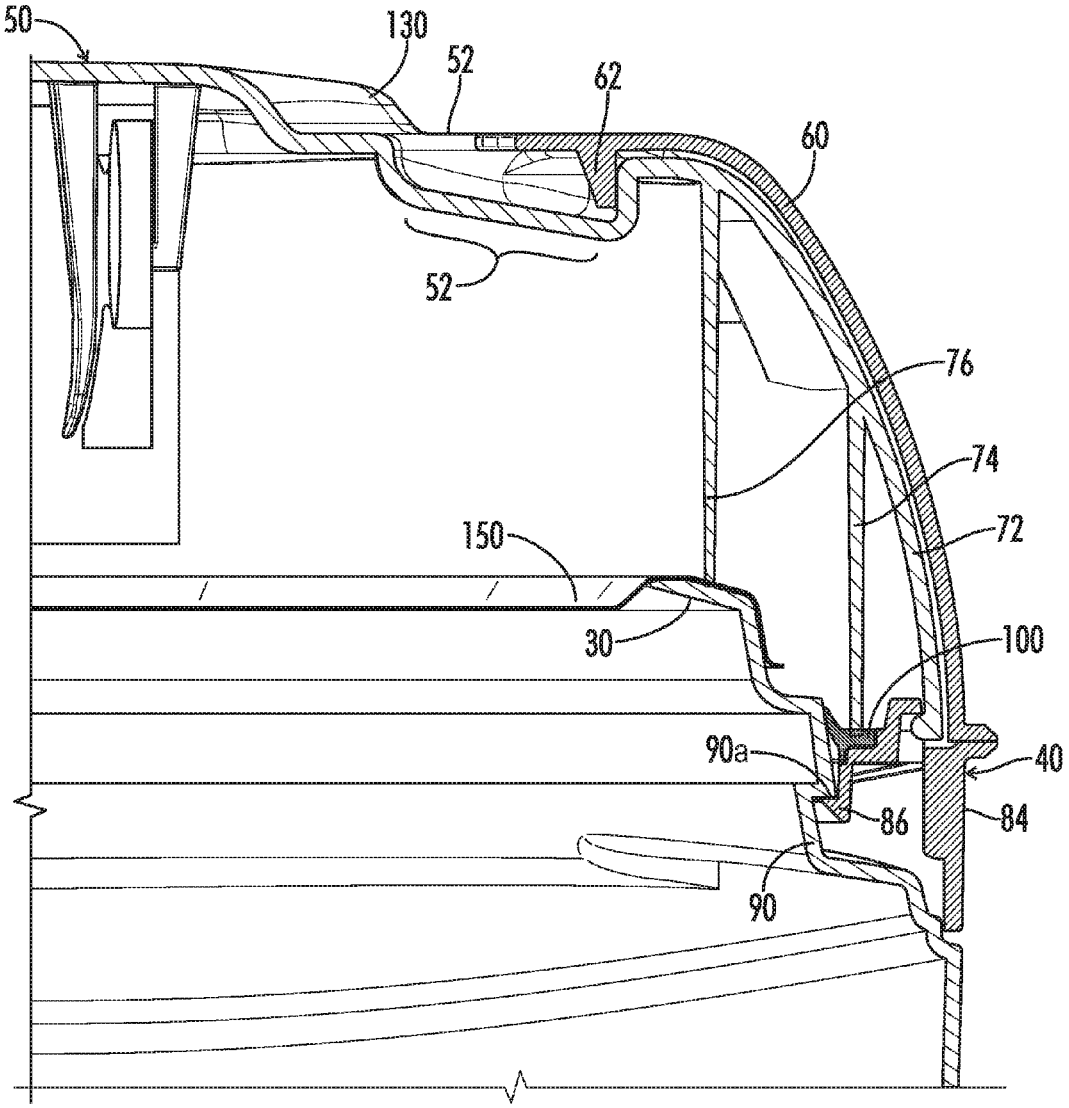
FIG. 14 shows a cross-section view of the tub, collar, gasket, and lid, wherein the latch is in closed position on the lid.
Figure 15:
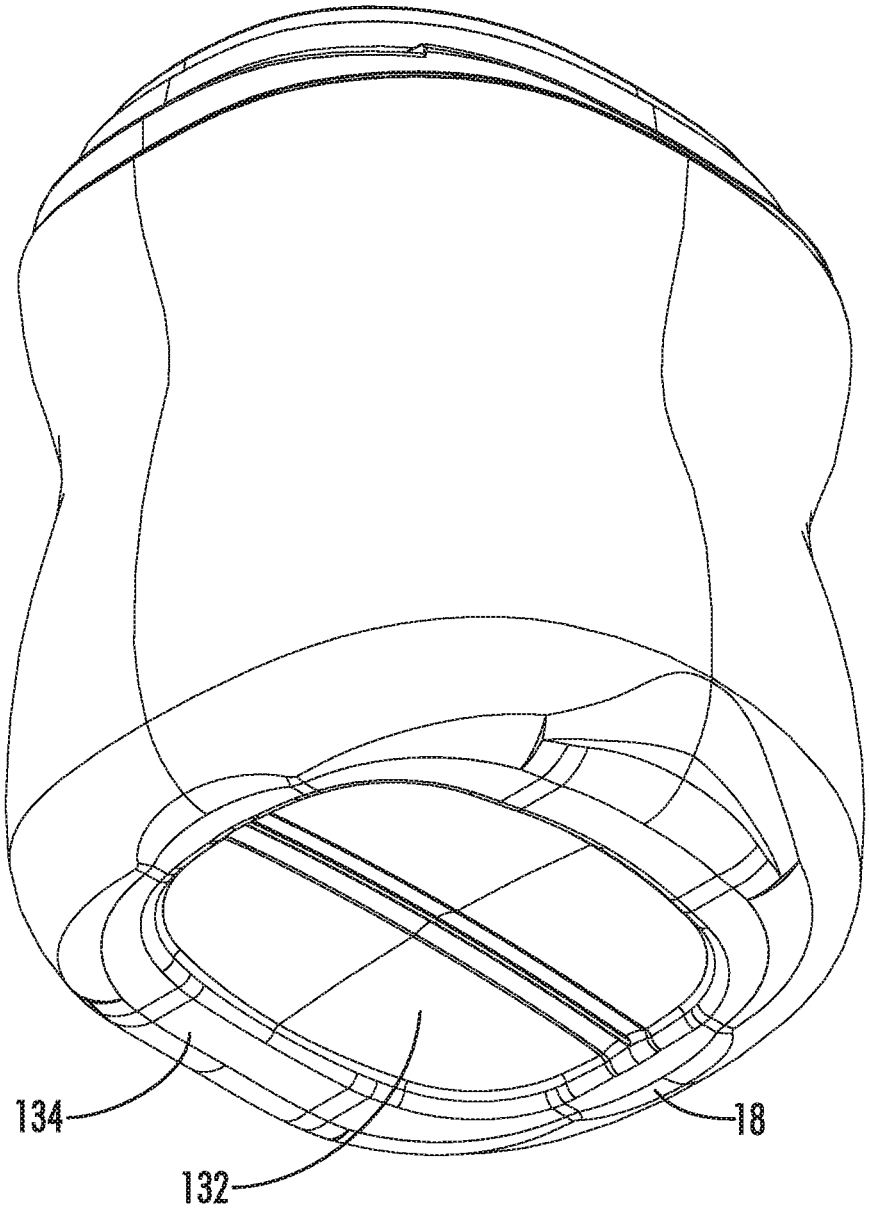
FIG. 15 shows a bottom view of the tub of the container.

Referring not to FIGS. 14 and 15, the lid 50 of the container may further be shaped to cooperate with the features of the base 18 to enable stacking of multiple containers. For example in some embodiments, the lid 50 is shaped having a general convex surface. In this embodiment, the base is 18 is designed to include a concave surface that is complimentary to the convex surface of the lid 40, such that the convex surface of the lid 50 fits within the concave surface of the base 18.

Figure 16:
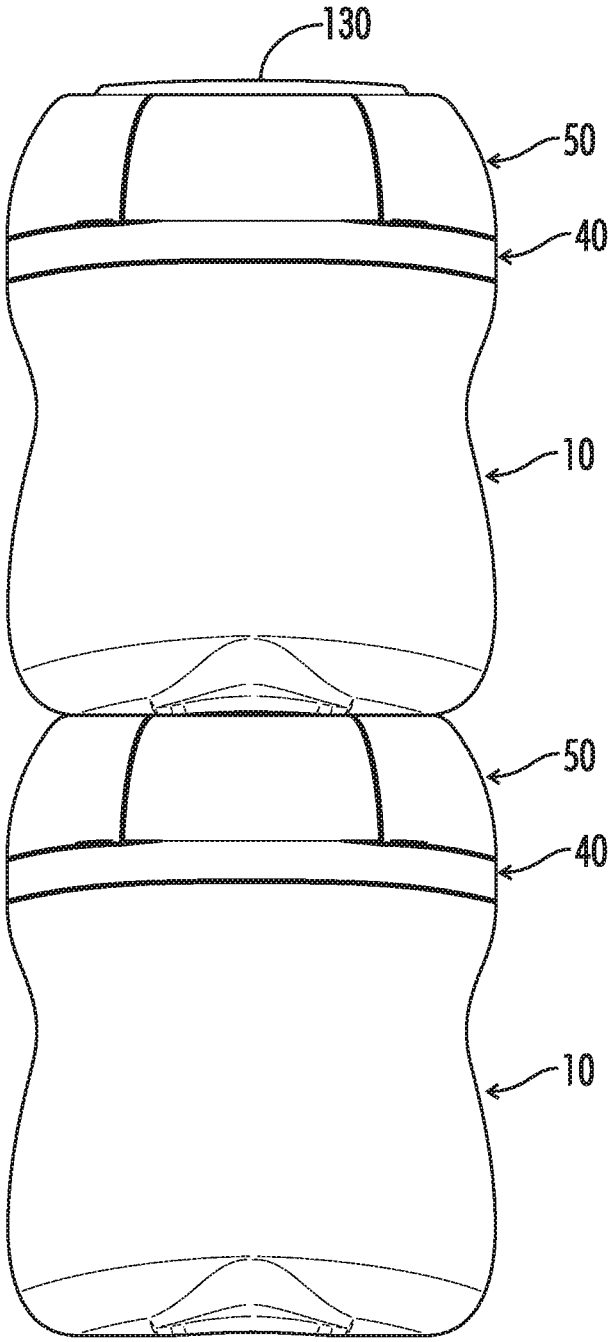
FIG. 16 shows multiple containers stacked on top of each other.

In some embodiments, the outer top surface 52 of the lid 50 includes a raised center portion 130. See FIG. 14. In this embodiment, the base 18 of the tub 10 may comprise a recessed center portion 132. See FIG. 15. The raised center portion 130 of the lid 50 and the recessed center portion 132 of the base 18 are designed to be complementary in overall shape and size. For example, the raised center portion 130 of the lid 50 may generally have an ellipsoidal or oval shape having a certain width, length and height that is complementary to the width, length and height of the recessed center portion 132 of the base 18. Accordingly, the raised center portion 130 of the lid 50 may be placed inside the recessed center portion 132 of the base 18, thereby allowing one container to be stacked on top of another container. See. FIG. 16.

The raised center portion 130 of the lid 50 and the corresponding recessed center portion 132 of the base 18 may comprise a variety of shapes including but not limited to rectangular shapes, circular shapes, or ellipsoidal shapes. The height of the raised center portion 130 of the lid 50, in some embodiments, is generally the same height as the recessed center portion 132 of the base 18, thereby allowing the outer perimeter 134 of the base to securely rest on the perimeter of the outer top surface 52 of the lid 50 when one container is stacked on top of another container. See. FIG. 16.

In some embodiments, the latch 60 is designed to comprise a raised portion to accommodate the recessed center portion 132 of the base 18 when one container is stacked on top of another container. As can be seen in FIG. 14, the latch 60 of the container is in closed position having the lid engaging flange 62 of the latch 60 securely engaged in the engagement recess 54 on the lid 50, thereby securely closing the container. To provide a complementary surface for the recessed center portion 132 of the base 18, the latch 60 is designed to have a raised portion to accommodate the stacking of the containers.

Figure 17:
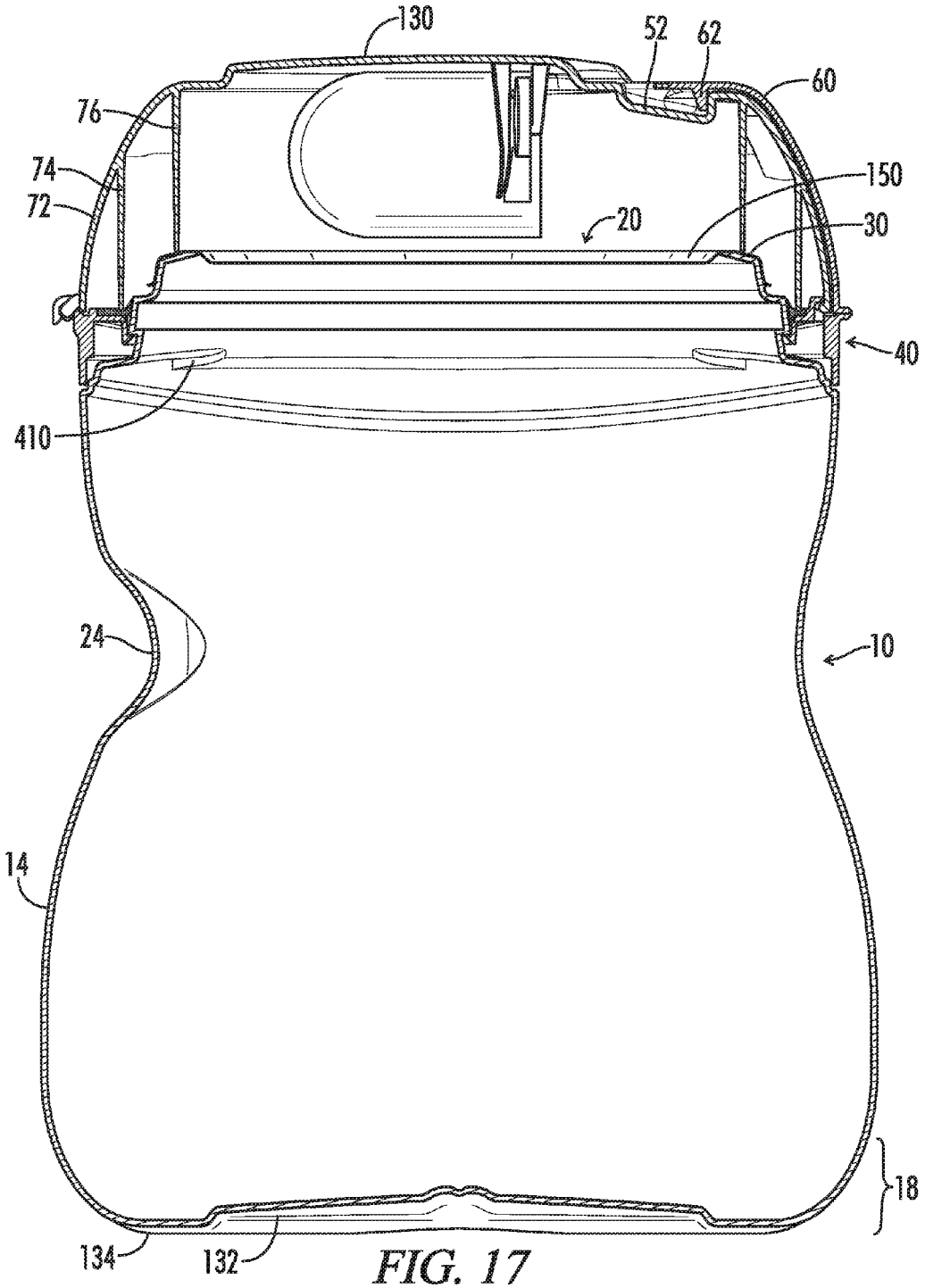
FIG. 17 shows a cross section view of the container including the sealable membrane.
Figure 18:
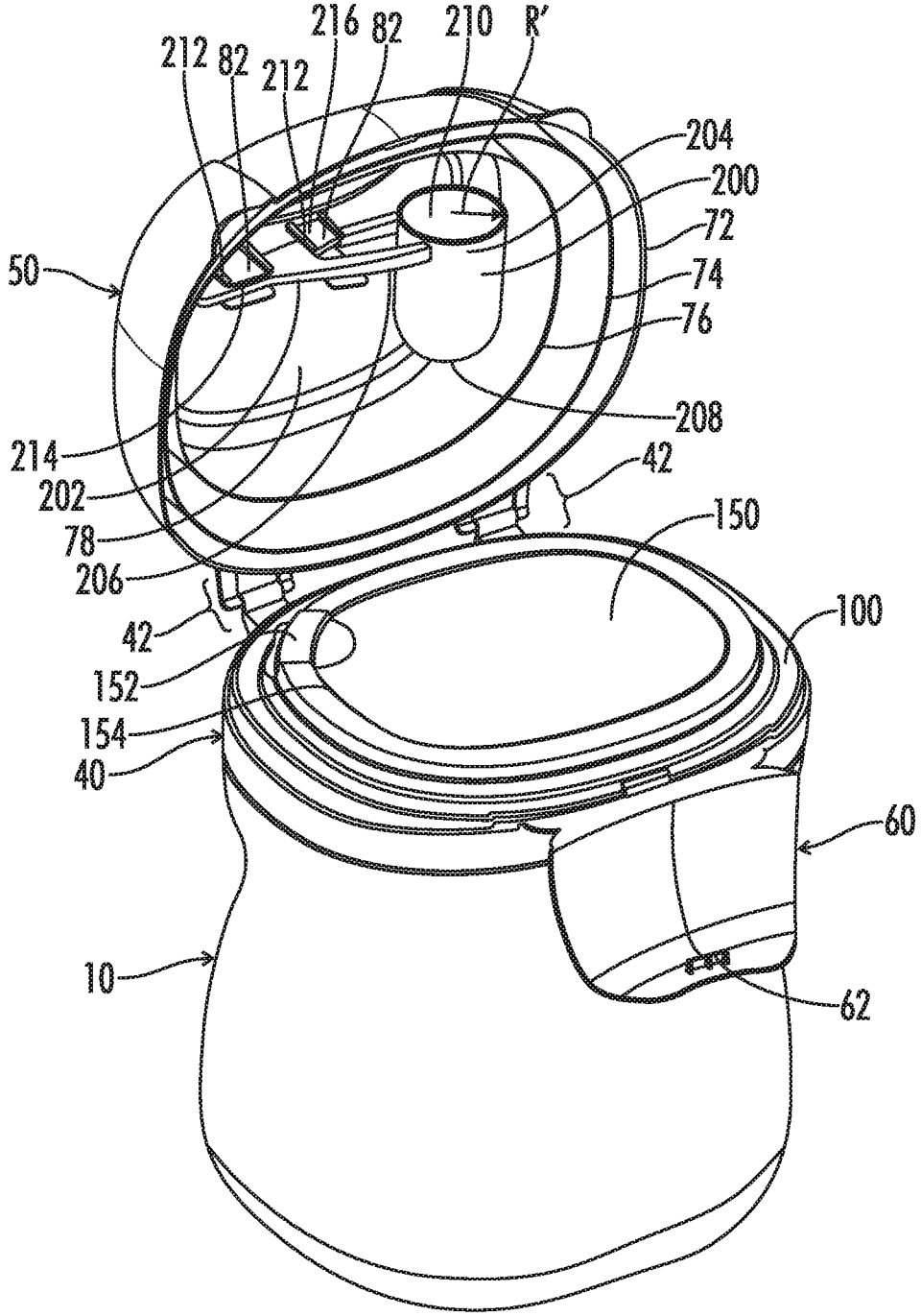
FIG. 18 is a cross section view of the container illustrating the scoop being releasably held by the scoop attachment mechanism.

The container of the present disclosure may also comprise a sealable membrane 150. The sealable membrane allows for vacuum packaging of the contents in tub 10 and provides a tamper evident inner liner. Referring to FIGS. 17 and 18, in some embodiments, the sealable membrane is placed over the opening 20 of the tub 10. The sealable membrane 150 may be sealed to the opening flange 30 of the tub 10. In some embodiments, the sealable membrane 150 is sealed and/or bonded around the entire perimeter of the tub 10 with a suitable adhesive. The adhesive used to seal the sealable membrane 150 to the tub 10 may be any adhesive known and/or used in the art. In some embodiments, the sealable membrane 150 may be bonded to the tub using heat.

One skilled in the art of food packaging will be familiar with such sealable membranes. Specifically, adhesive or heat may be used to bond the sealable membrane 150 formed of polypropylene, polyethylene laminated foil, polyvinyl chloride, polystyrene or other suitable material to the opening flange 30 to form an airtight seal. Since the sealable membrane 150 is secured to the opening flange 30 via adhesive and/or bonded via a mechanical weld, removal of lid 50 will not disturb the sealable membrane 150 unless the sealable membrane 150 is cut or removed.

As can be seen in FIG. 18, the sealable membrane 150 may comprise a tab 152. Once the lid 50 is in an open position, the tab 152 may be gripped by the user such that the user can remove the sealable membrane 150 from the opening flange 30 of the tub 10. In some embodiments, the tab 152 is folded over and rests on the top surface of the sealable membrane 150 until it is gripped by the user. Still, in some embodiments, the tab 152 of the sealable membrane 150 extends laterally away from the opening flange 30 of the tub 10 and is folded to be generally parallel with the outer perimeter of the neck 26 of the tub 10.

In some embodiments the tab 152 is positioned on the corner of the tub. Placing the tab 152 in this position focuses and directs the initial peel force, which facilitates ease of removing the sealable membrane 150 from the tub 10. Thus, placing the tab 152 generally in a location that corresponds to the corner of the tub 10, allows for the sealable membrane 150 to be completely removed. Accordingly, the user does not have to spend additional time removing pieces of the sealable membrane 150 or potentially contaminating or soiling the product of the tub 10 when removing the sealable membrane 150.

When the lid 50 is in a closed position, the inner sealing wall 76 of the lid 50 may rest on the surface of the sealable membrane 150 along the opening flange 30 of the tub 10. However, in some embodiments, the tab 152 of the sealable membrane 150 is positioned such that when the lid 50 is closed the sealable membrane 150 is not pinched between the second lid sealing wall 74 and the collar 40 and/or the second lid sealing wall 74 and the gasket 100. In this manner, the integrity of the tab 152 of the sealable membrane 150 is maintained. For example, if the sealable membrane 150 is crushed or depressed by the second lid sealing wall 74 of the lid 50 when the lid 50 is in closed position, then sealable membrane 150 especially the tab 152 portion may crumple, rip, or tear. If damage such as this occurs to the tab 152 of the sealable membrane 150, then the user may have difficulty removing the sealable membrane 150 from the tub 10. Accordingly, in some embodiments, the tab 152 is designed having a shape and length such that it will not be caught between the second lid sealing wall 74 and the collar 40 and/or gasket 100.

In some embodiments, the sealable membrane 150 may comprise a utensil accommodating recess 154 that extends into the opening 20 of the tub 10 when the sealable membrane 150 is secured to the tub 10. For example, as shown in FIGS. 17-18, in some embodiments the utensil accommodating recess 154 extends into the interior space 22 of the tub 10 below the opening flange 30 of the tub 10. In this manner, the accommodation recess 154 ensures that the sealable membrane 150 will not be pierced, torn or damaged in any way when the scoop 200 is secured in the scoop element 82 located on the inner top surface 78 of the lid 50.

Still referring to FIGS. 17 and 18, in some embodiments the container may comprise a scoop 200. Scoop 200 may be a scoop molded from a suitable plastic material, which may be blow molded by an extrusion or injection process. Suitable plastics for forming the dispending utensil 200 include, but are not limited to, various food grade polymers such as polystyrene, polystyrene-acrylonitile, acrylonitile-butadiene-styrene, styrene-maleicanhydride, polycarbonate, polyethylene terephthalate, polyvinylcyclohexane, and blends thereof.

As shown in FIG. 18, the scoop 200 has a generally flat handle 202 attached to or integrally formed with a scooping mechanism 204 having a radius R'. A rib 206 may be utilized and connected to the underside of the handle and the scooping mechanism 204 to provide structural stability to the scoop 200. In some embodiments, the scooping mechanism 204 is closed at one end 208 and open at a second end 210. In some embodiments, the scooping mechanism 204 comprises a cylindrical bowl. The bowl 204 may be formed in many other shapes including, but not limited to square, rectangular, oval, etc.

The scoop 200 may be releasably secured to the lid 50 of the tub 10 by a scoop attachment element 82 located on the inner top surface 78 of the lid 50, as shown in FIG. 18. The scoop attachment element 82 may include multiple flexible tabs 212 arranged to releasably secure the scoop 200 to the inner top surface 78 of the lid 50. The flexible tabs 212 may be centrally located on the inner top surface 78 of the lid within the raised center portion 130. In some embodiments, a set of three tabs 212 are arranged to secure the handle portion 202 of the scoop 200 and a set of two tabs 212 are arranged to secure the bowl 204. Each tab 212 may contain a protrusion 214 that assists in securing scoop 200 to the lid 50 when the lid 50 is secured tub 10. Moreover, a rib 216 may be used to strengthen the tabs 212 and two generally triangular ribs 218 may be used to support the bowl 204 of the scoop 200.

Consequently, due to the scoop attachment element 82, the scoop 200 does not become buried in the granulated material located in the tub 10 and thereby eliminates the need for the user to dig through the contents in search of the scoop 200. This is especially important when the container's contents are for human consumption and contact with the hands is undesirable.

Figure 19:
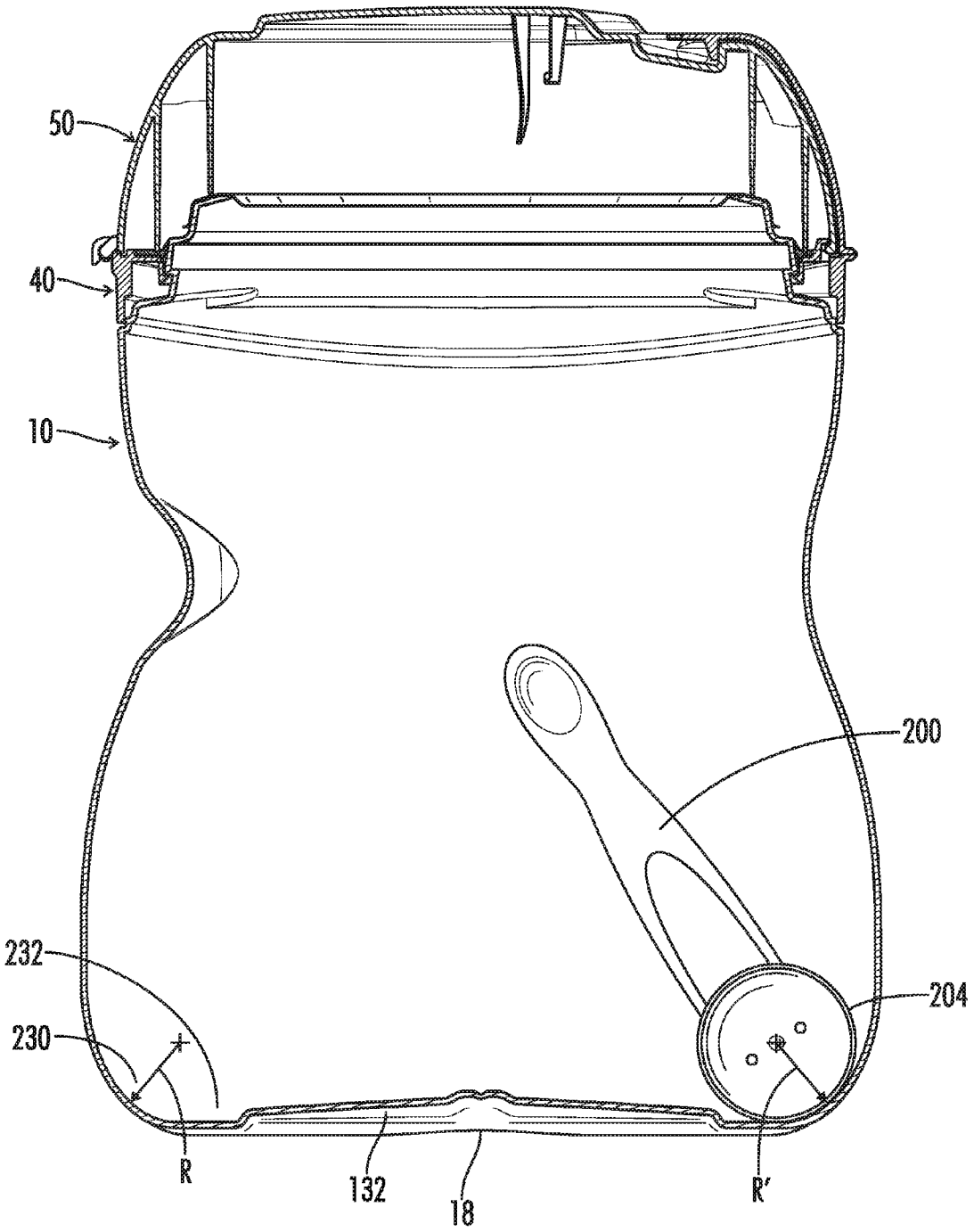
FIG. 19 is a cross section view of the container illustrating the circumferential channel located in the base of the container.

Referring now to FIG. 19, in addition to allowing containers to be stacked, the recessed center portion 132 of the base 18 serves a second purpose. In some embodiments, the recessed center portion 132 of the base 18 forms a circumferential channel 230 at the bottom of the tub 10. Generally, this channel 230 is formed between the area where wall(s) of the tub 10 meets the base 18, and the recessed center portion 132 of the base 18. The channel 230 is sized and shaped to receive cylindrical bowl 204 of scoop 200. The channel 230 may further include a radius R. In particular, the radius R' of cylindrical bowl 204 is approximately equal to or smaller than the radius of curvature R of the inside surface 232 of circumferential channel 230.

The recessed center portion 132 of the base 18 and the wall of the tub 10 causes the granulated contents to gravitate into the channel 230 as the product is being used up. Therefore, the bowl 204 fits into the channel 230 and allows the user to scoop out substantially all the granulated contents in the container with little effort (such a channel/bowl arrangement would also allow the container to be utilized for liquid containment and dispensing if desired.). No matter what shape the channel 230 is, the bowl 204 should be sized and shaped to be received in channel 230. For example, a square-shaped channel would require a bowl that would fit in the channel. In particular, the bowl 204 should be shaped to facilitate scooping the contents of the tub 10 out of channel 230 and, therefore, is most often the same shape as the channel 230.

All references cited in this specification, including without limitation, all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinence of the cited references.

Although embodiments of the disclosure have been described using specific terms, devices, and methods, such description is for illustrative purposes only. The words used are words of description rather than of limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. Therefore, the spirit and scope of the appended claims should not be limited to the description of the versions contained therein.

What is claimed is:

1. A container comprising:

a tub having an opening flange defining the opening of the tub and a continuous groove located in upper portion of the tub;

a collar having a gasket and also having a tub mating surface extending about the entire perimeter of the collar for engaging the groove of the tub thereby securing the collar to the tub, wherein the collar comprises an outer wall and a laterally extending flange extending from the outer wall toward the tub and having either a U-shape or a V-shape at the end of the laterally extending flange extending which provides flexibility to the collar; and a lid hingedly attached to the collar, the lid comprising an outer sealing wall, a second lid sealing wall and an inner sealing wall, wherein one end of the outer sealing wall engages the collar thereby creating a seal between the lid and collar, one end of the second lid sealing wall engages at least one surface of the gasket thereby creating a seal between the lid and gasket, and at least one end of the inner sealing wall engages the opening flange of the tub thereby creating a seal between the lid and tub;

wherein the tub mating surface comprises at least one thinned area to facilitate fitting the collar onto the tub.

2. The container of claim 1, wherein the tub further comprises an anti-rotation element.

3. The container of claim 2, wherein the collar further comprises at least one rib to engage the anti-rotation element of the tub.

4. The container of claim 1, wherein the continuous groove comprises a collar mating surface that engages the tub mating surface of the collar providing a continuous annular seal between the tub and collar.

5. The container of claim 1, wherein the collar comprises an outer sealing wall having one end in contact with upper portion of the tub to create a seal between the collar and the tub.

6. The container of claim 5, wherein the tub mating surface is located on a top surface of the collar that laterally extends from the outer sealing wall toward the tub.

* * * * *